US007210510B2

(12) United States Patent
Barclay deTolly

(10) Patent No.: US 7,210,510 B2
(45) Date of Patent: May 1, 2007

(54) WORK BENCH

(75) Inventor: Paul E. Barclay deTolly, Portsmouth, RI (US)

(73) Assignee: Tracrac, Inc., Fall River, MA (US)

( * ) Notice: Subject to any disclaimer, the term of this patent is extended or adjusted under 35 U.S.C. 154(b) by 0 days.

(21) Appl. No.: 10/887,304

(22) Filed: Jul. 9, 2004

(65) Prior Publication Data

US 2005/0006002 A1 Jan. 13, 2005

Related U.S. Application Data

(60) Provisional application No. 60/485,719, filed on Jul. 10, 2003.

(51) Int. Cl.
*B25H 1/00* (2006.01)

(52) U.S. Cl. ..... 144/286.1; 144/286.5; 144/269

(58) Field of Classification Search ..... 144/286.1, 144/286.5, 287, 269, 1.1; 269/99; 83/477.1
See application file for complete search history.

(56) References Cited

U.S. PATENT DOCUMENTS 5,193,598 A 3/1993 Estrem
5,494,327 A * 2/1996 Derecktor ..... 296/3
5,526,856 A * 6/1996 Pedri ..... 144/287
5,564,681 A * 10/1996 Glass ..... 269/271
5,592,981 A * 1/1997 Derecktor ..... 144/286.1
RE35,627 E * 10/1997 Estrem ..... 144/329
5,836,365 A * 11/1998 Derecktor ..... 144/287
5,848,743 A 12/1998 Derecktor
D410,429 S 6/1999 Derecktor
6,199,608 B1 * 3/2001 Ayala et al. ..... 144/286.1
6,293,176 B1 * 9/2001 Talesky ..... 83/438
6,547,311 B1 4/2003 Derecktor
6,745,804 B2 * 6/2004 Welsh et al. ..... 144/287
2004/0250901 A1 * 12/2004 Ursell et al. ..... 144/286.1

* cited by examiner

*Primary Examiner*—Bena Miller
(74) *Attorney, Agent, or Firm*—Pillsbury Winthrop Shaw Pittman LLP

(57) ABSTRACT

A work bench includes an elongated main body including a track portion having first and second spaced apart rail members. A tool mount assembly includes a tool mount having a support structure that supports a tool and a releasable fastener mounted to the support structure to releasably interlock with the track portion so as to releasably mount the tool mount to the track portion. The fastener includes a handle and a retaining member movable along with the handle such that manual movement of the handle to (a) a released position positions the retaining member so that the tool mount can be engaged with or disengaged from the track portion, and (b) a locked position moves the retaining member into forced engagement with the spaced apart rail members to secure the tool mount to the track portion.

32 Claims, 30 Drawing Sheets

WORK BENCH

CROSS-REFERENCE TO RELATED APPLICATIONS

The present application claims priority to U.S. Provisional Application of Barclay de Tolly, Ser. No. 60/485,719, filed Jul. 10, 2003 the entirety of which is hereby incorporated into the present application by reference.

FIELD OF THE INVENTION

The present invention relates to work benches.

BACKGROUND OF THE INVENTION

Work benches are known in the art. Examples of work benches are disclosed in U.S. Pat. Nos. 5,592,981 and 5,836,365. One aspect of the present invention is to provide improvements to known work benches.

SUMMARY OF THE INVENTION

One aspect of the invention relates to a work bench including an elongated main body including a track portion having first and second spaced apart rail members. A tool mount assembly is removably mounted to the track portion of the main body to stably support a tool on the main body. The tool mount assembly includes a tool mount having a support structure that supports the tool and a releasable fastener mounted to the support structure to releasably interlock with the track portion so as to releasably mount the tool mount to the track portion. The releasable fastener includes a handle and a retaining member movable along with the handle. The handle has a surface engaged with a handle mount surface provided on the support structure such that manual movement of the handle to (a) a released position positions the retaining member so that the tool mount can be engaged with or disengaged from the track portion, and (b) a locked position rotates the retaining member relative to the support structure and moves the retaining member axially by camming the surface of the handle against the handle mount surface so that ends of the retaining member are moved into forced engagement with the spaced apart rail members to secure the tool mount to the track portion and prevent relative movement of the tool mount with respect to the track portion.

Another aspect of the invention relates to a tool mount assembly for use with an elongated main body including a track portion having first and second spaced apart rail members. The tool mount assembly includes a tool mount having a support structure that supports a tool and a releasable fastener mounted to the support structure to releasably interlock with the track portion so as to releasably mount the tool mount to the track portion. The releasable fastener includes a handle and a retaining member movable along with the handle. The handle has a surface engaged with a handle mount surface provided on the support structure such that manual movement of the handle to (a) a released position positions the retaining member so that the tool mount can be engaged with or disengaged from the track portion, and (b) a locked position rotates the retaining member relative to the support structure and moves the retaining member axially by camming the surface of the handle against the handle mount surface so that ends of the retaining member are moved into forced engagement with the spaced apart rail members to secure the tool mount to the track portion and prevent relative movement of the tool mount with respect to the track portion.

Still another aspect of the invention relates to a vise for use with an elongated main body including a track portion having first and second spaced apart rail members. The vise includes a base and a pair of engagement members provided on the base. The engagement members are relatively movable toward and away from one another for grasping and releasing a workpiece. A releasable fastener is mounted to the base to releasably interlock with the track portion so as to releasably mount the vise to the track portion. The releasable fastener includes a handle and a retaining member movable along with the handle. The handle has a surface engaged with a handle mount surface provided on the base such that manual movement of the handle to (a) a released position positions the retaining member so that the vise can be engaged with and disengaged from the track portion, and (b) a locked position rotates the retaining member relative to the base and moves the retaining member axially by camming the surface of the handle against the handle mount surface so that ends of the retaining member are moved into forced engagement with the spaced apart rail members to secure the vise to the track portion and prevent relative movement of the vise with respect to the track portion.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
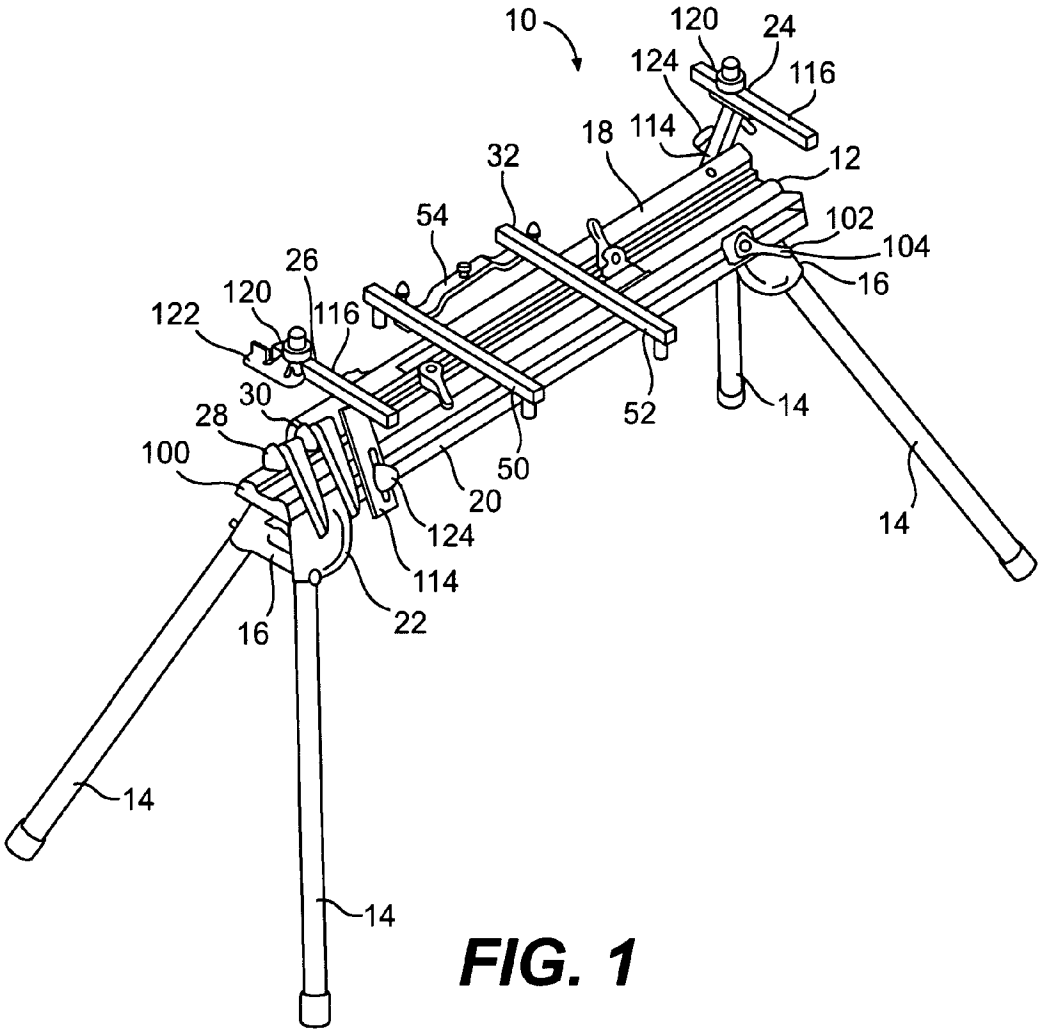
FIG. 1 is a perspective view of a work bench constructed in accordance with an embodiment of the present invention, the pair of support arms and the adjustable stop arm of the work bench in retracted positions.

FIG. 1 illustrates a work bench 10 constructed in accordance with one illustrated embodiment of the present invention. The work bench 10 is especially suited for portable use, since it can be folded into a compact package and easily set-up to achieve a use configuration when it is desired.

Figure 2:
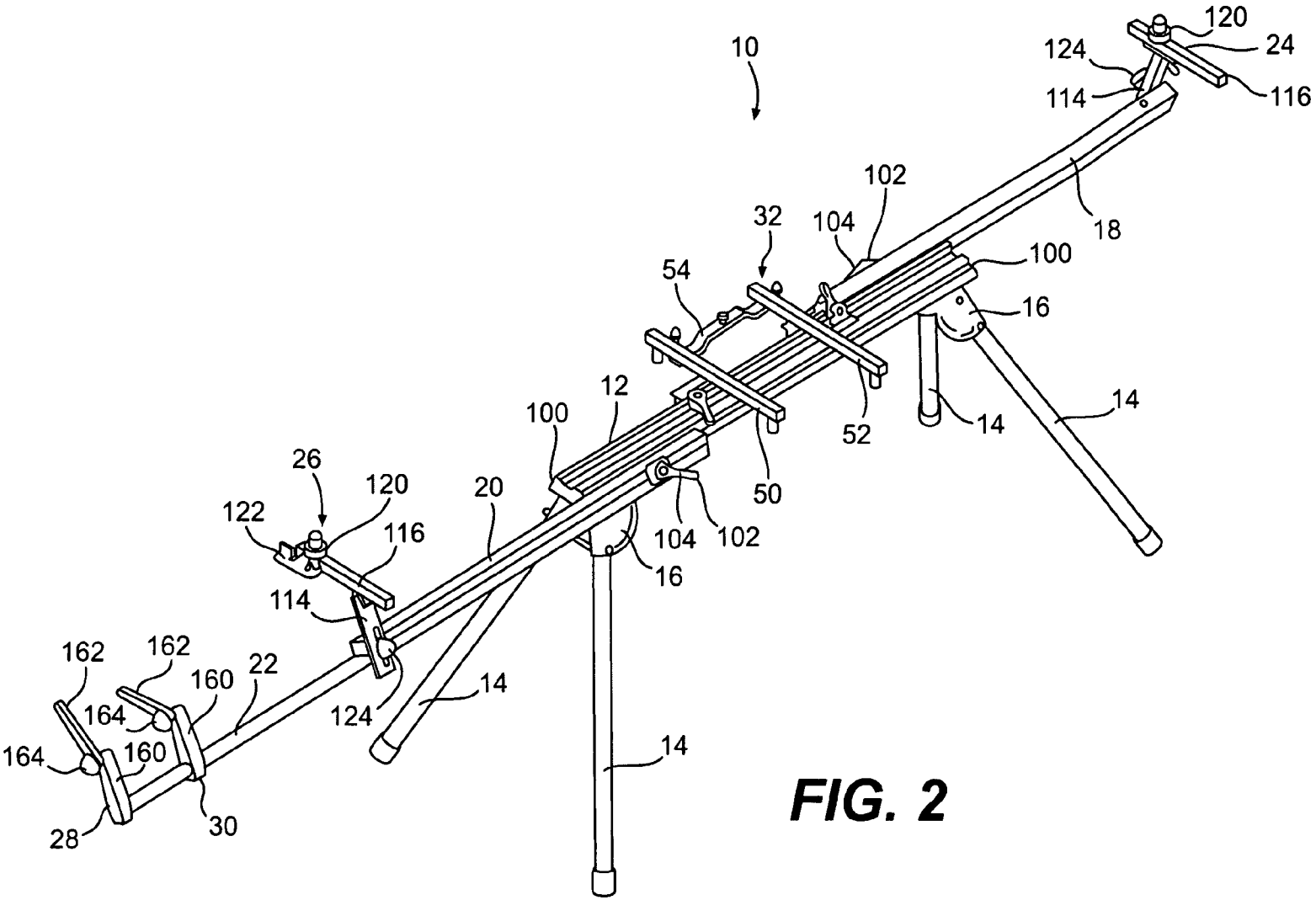
FIG. 2 is a perspective view of the work bench shown in FIG. 1 with the pair of support arms and the adjustable stop arm thereof in extended positions.

The work bench 10 includes an elongated main body 12, four legs 14, and two connection brackets 16 for mounting the legs 14 to the main body 12. The connection brackets 16 enable the legs 14 to be pivotable between an open position (as shown in FIGS. 1 and 2) in which the legs 14 extend generally away from the main body 12, and a closed position in which the legs 14 extend generally parallel to the main body 12. In the open position, the legs 14 support the main body 12 in an elevated position above the ground. Details of structure and operation of legs and connection brackets are disclosed in U.S. Pat. Nos. 5,592,981 and 5,836,365, the entireties of which are herein incorporated by reference. However, the legs and connection brackets may have any suitable construction, and the one disclosed herein is not intended to be limiting.

The work bench 10 includes a pair of elongated support arms 18, 20 that are movable relative to the elongated main body 12 between a retracted position, as shown in FIG. 1, and a plurality of extended positions, one of which is shown in FIG. 2. In the extended positions, a free end of respective support arms 18, 20 extends outwardly away from the main body 12. The work bench 10 also includes an adjustable elongated stop arm 22 that is telescopically mounted to the either support arm 18, 20 for movement between a retracted position, as shown in FIG. 1, and a plurality of extended positions, one of which is shown in FIG. 2. In the extended position, a free end of the adjustable stop arm 22 extends outwardly away from either support arm 18, 20. In the illustrated embodiment, the adjustable stop arm 22 is mounted to the support arm 20. Although not illustrated, it would likewise be possible to have a second adjustable stop arm on support arm 18 also.

In the illustrated embodiment, an adjustable work support assembly 24 is mounted on the support arm 18, an adjustable work support/stop assembly 26 is mounted on the support arm 20, and a pair of flip stop assemblies 28, 30 are mounted on the adjustable stop arm 22. Also, a tool mount assembly 32 is removably mounted to the main body 12 for supporting a tool, such as a saw, router, drill press, etc., thereon.

The adjustable work support assembly 24, the adjustable work support/stop assembly 26, and the pair of flip stop assemblies 28, 30 are provided to support and/or set cutting lengths for items to be cut by the tool supported on the tool mount assembly 32, such as lumber. Also, the adjustable work support assembly 24, the adjustable work support/stop assembly 26, and the pair of flip stop assemblies 28, 30 are mounted such that they may be adjusted by hand without having to resort to using tools, as will be further discussed.

Figure 5:
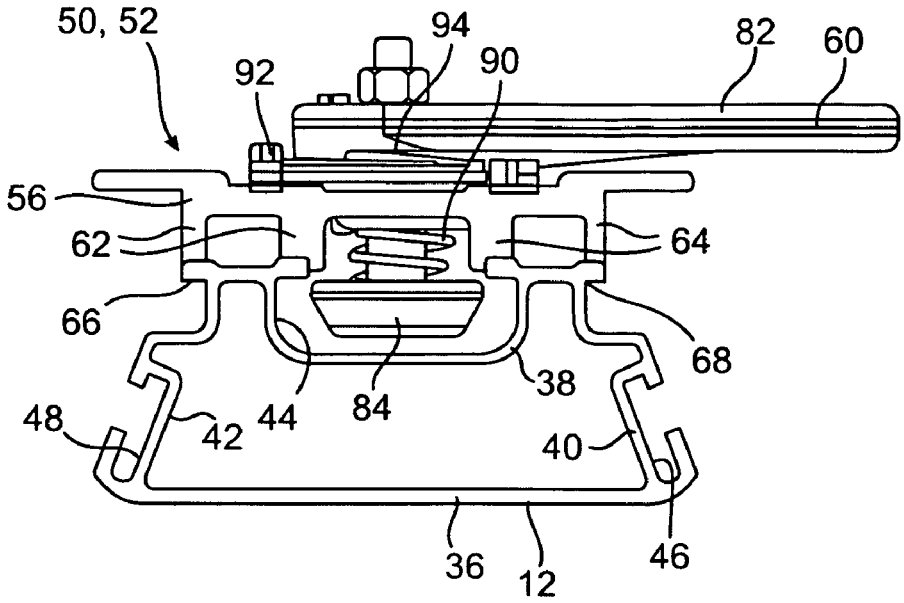
FIG. 5 is a cross-sectional view illustrating a tool mount of the tool mount assembly shown in FIG. 3 engaged with the main body of the work bench shown in FIG. 1, the clamp assembly of the tool mount in a released position.

As best shown in FIG. 5, the main body 12 of the work bench 10 has an elongated, tubular construction with a bottom wall 36, a top wall 38 opposite the bottom wall 36, and a pair of side walls 40, 42 which interconnect the bottom and top walls 36, 38, respectively. The top wall 38 provides a first track portion 44, the side wall 40 provides a second track portion 46, and the side wall 42 provides a third track portion 48. The track portions 44, 46, 48 extend along the length of the main body 12. Preferably, the main body 12 is fabricated by extrusion from aluminum, which is found to be lightweight, easy to manufacture, and strong in construction. However, the main body 12 may be made from any other suitable material, may be made by any suitable process, and may have a different configuration. Also, it should be understood that any number of track portions may be provided on the main body 12.

Figure 3:
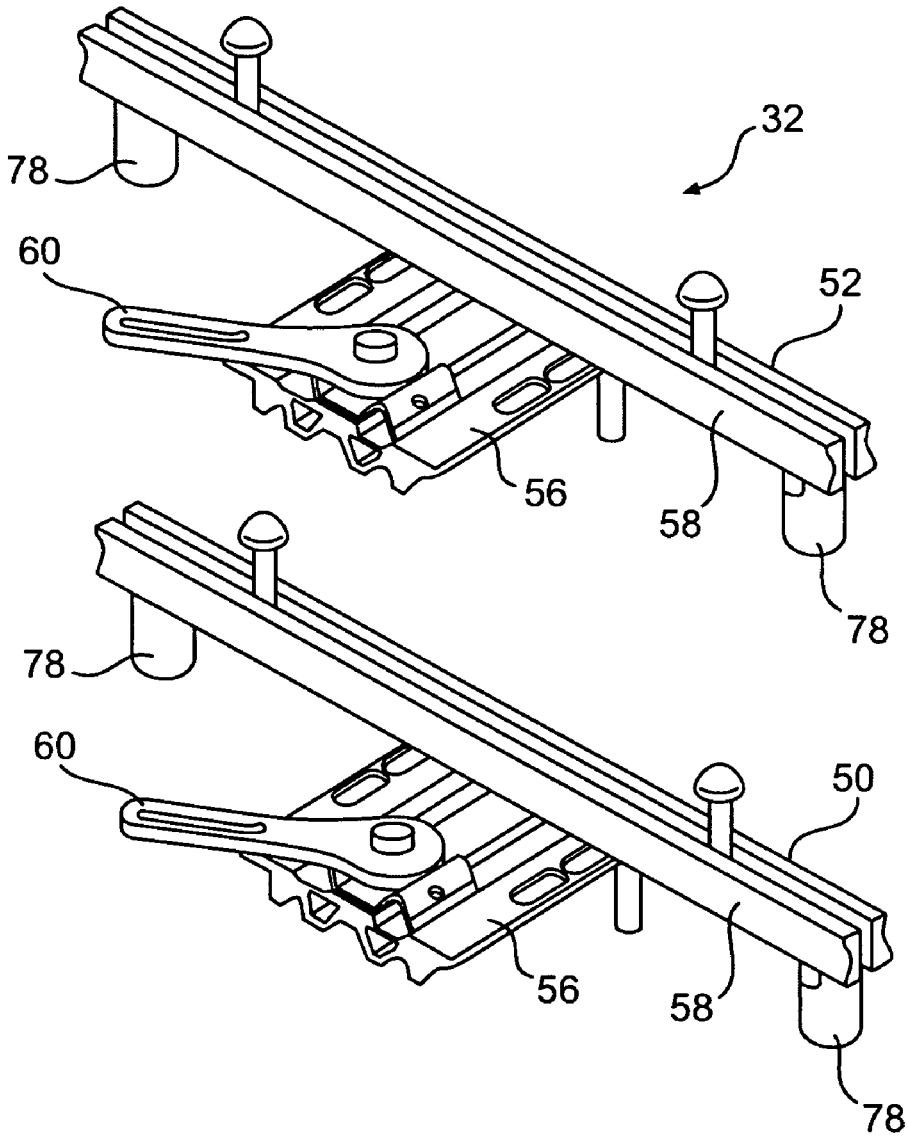
FIG. 3 is a perspective view of an embodiment of a tool mount assembly structured for use with the work bench shown in FIG. 1.

The tool mount assembly 32 is removably mountable to the first track portion 44 for supporting a tool on the main body 12 in a stable manner. As shown in FIG. 3, the tool mount assembly 32 includes a pair of tool mounts 50, 52. In use, one tool mount 50 supports one side of a tool and the other tool mount 52 supports the other side of the tool. As shown in FIGS. 1 and 2, an additional support 54 may be secured between the tool mounts 50, 52 to add an additional mounting point for the tool. However, this additional support 54 is optional, depending on the structure of the tool.

Figure 4:
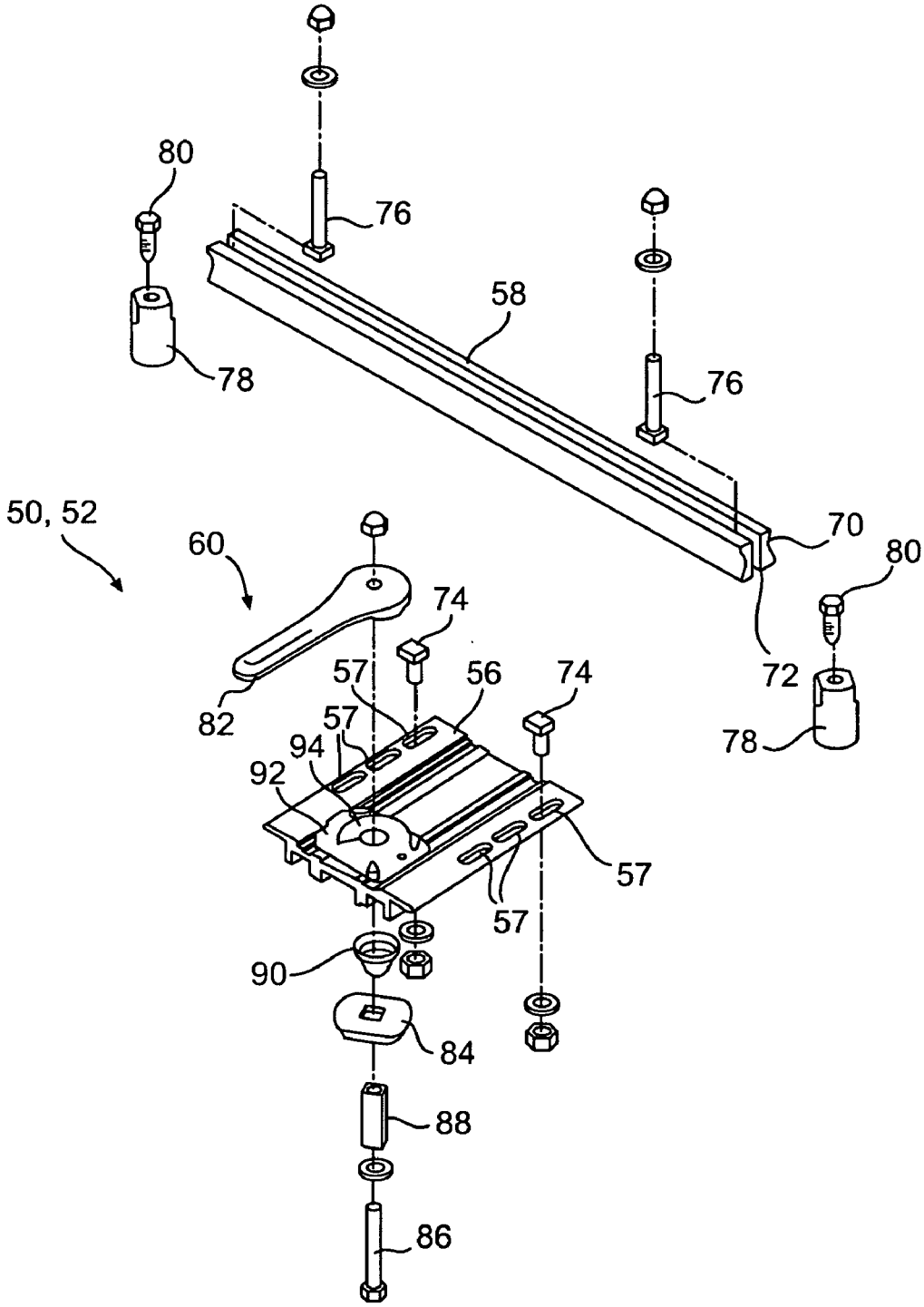
FIG. 4 is an exploded view of a tool mount of the tool mount assembly shown in FIG. 3.

As shown in FIGS. 3 and 4, each tool mount 50, 52 includes a base 56, a support beam 58 mounted to the base 56, a releasable fastener 60 mounted to the base 56 for securing each tool mount 50, 52 to the first track portion 44.

As shown in FIG. 5, the base 56 has a first pair of lateral flanges 62 and a second pair of lateral flanges 64 structured to engage the first track portion 44. Specifically, the first track portion 44 includes first and second rail members 66, 68 each having inwardly and outwardly extending flanges. In use, the base 56 is engaged with the first track portion 44 such that the first pair of lateral flanges 62 engage the first rail member 66 and the second pair of lateral flanges 64 engage the second rail member 68. Inner lateral flanges of the first and second pairs of lateral flanges 62, 64 engage the inwardly extending flanges of respective first and second rail members 66, 68 to allow sliding movement of the base 56 longitudinally along the first track portion 44 but prevent lateral movement of the base 56 with respect to the first track portion 44. The outer flanges of the first and second pairs of lateral flanges 62, 64 engage the outwardly extending flanges of the rail members 66, 68 to provide additional support.

As shown in FIG. 4, the support beam 58 has a general H-shape that defines an upper track portion 70 and a lower track portion 72. The side walls of the upper track portion 70 have inwardly extending flanges and the side walls of the lower track portion 72 have inwardly extending flanges. A pair of fasteners 74 secure the support beam 58 to the base 56. Specifically, the heads of the fasteners 74 are received in the lower track portion 72 and engage the inwardly extending flanges thereof. The threaded shafts of the fasteners 74 extend through respective openings 57 in the base 56 and into threaded engagement with respective nuts. Several openings 57 are provided in the base 56 to allow different mounting positions of the support beam 58 with respect to the base 56.

Also, fasteners 76 are retained in the upper track portion 70 by the inwardly extending flanges thereof for securing the tool to the support beam 58 of the respective tool mount 50, 52. The fasteners 76 of respective tool mounts 50, 52 may directly engage the tool to secure the tool to the tool mounts 50, 52. Alternatively, the fasteners 76 of the tool mounts 50, 52 may cooperate to secure a support plate, with the tool being mounted to the support plate, as is shown in U.S. Pat. No. 5,836,365.

As shown in FIGS. 3 and 4, rubber or plastic feet 78 are mounted to the ends of the support beam 58. Specifically, fasteners 80 have their heads retained in the lower track portion 72 of the support beam 58 and are threadably engaged with the feet 78 to secure the feet 78 to the support beam 58. As a result, the tool mounts 52, 52 may be released from the work bench 10 and positioned on a horizontal support surface, such as a work table or a floor. In use, the feet 78 stably support the tool mounts 50, 52 on the support surface and absorb vibrations from the tool mounted thereon.

Figure 6:
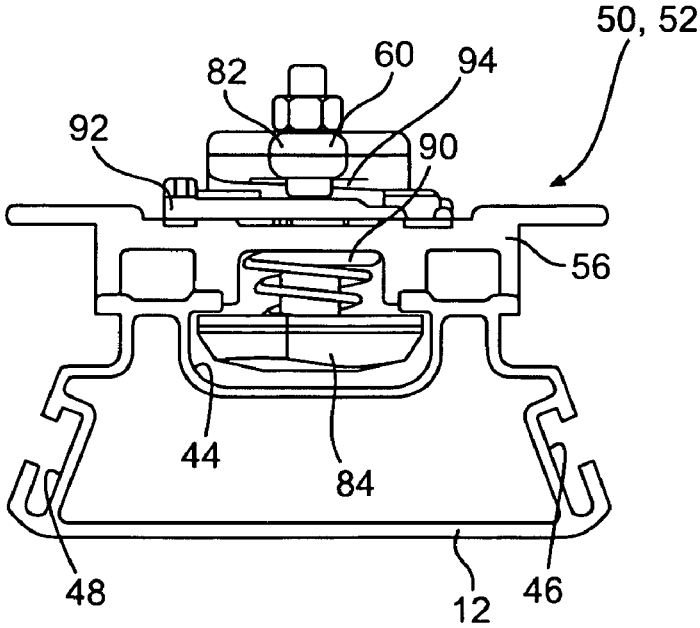
FIG. 6 is a view similar to FIG. 5 illustrating the clamp assembly of the tool mount in an intermediate position.
Figure 7:
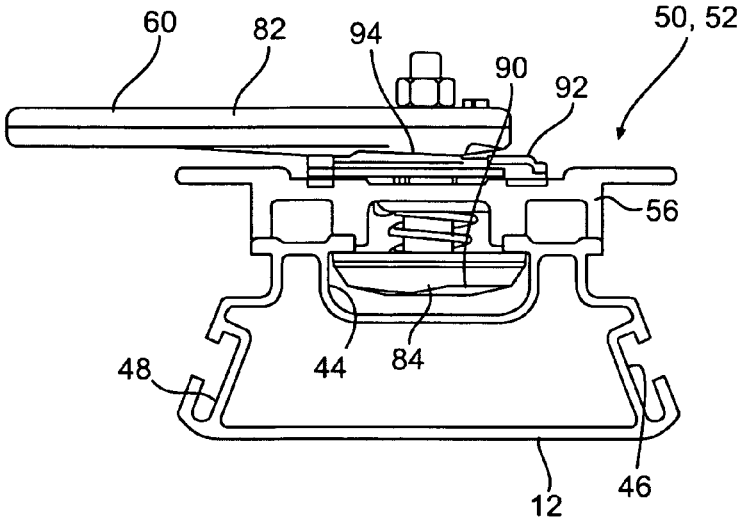
FIG. 7 is a view similar to FIG. 5 illustrating the clamp assembly of the tool mount in a locked position.

In the illustrated embodiment, the fastener 60 is in the form of a clamp assembly. The clamp assembly 60 is structured to releasably interlock with the first track portion 44 so as to releasably mount each tool mount 50, 52 to the first track portion 44. Specifically, the clamp assembly 60 includes a handle 82 pivotably mounted to the base 56 for movement between a released position (as shown in FIG. 5), an intermediate position (as shown in FIG. 6), and a locked position (as shown in FIG. 7). In the released position, each tool mount 50, 52 may be engaged with the first track portion 44, removed from first track portion 44 by upward movement, or slid along the first track portion 44. In the intermediate position, each tool mount 50, 52 is interlocked with the first track portion 44 for slidable movement along the first track portion 44, but is prevented from removal upwardly away from the first track portion 44. In the locked position, each tool mount 50, 52 is locked to the first track portion 44 to prevent any type of relative movement between the tool mounts 50, 52 and the first track portion 44. The handle 82 of the clamp assembly 60 may be manually moved between the released, intermediate, and locked positions to remove, adjust, and mount the tool mounts 50, 52 to the first track portion 44 as desired. The details of these positions will be described below.

The handle 82 is operatively engaged with a retaining member 84 to control the movement of the retaining member 84 into and out of engagement with the first track portion 44. Specifically, a fastener 86 with a handle key 88 extends through an opening in the retaining member 84, through an opening in the base 56, and into a locking engagement with the handle 82 which mates with the handle key 88 and is threaded for the fastener 86. A nut is used as a secondary fastener with the fastener 86, as shown in FIG. 4. As a result, rotation of the handle 82 rotates the retaining member 84.

A spring 90 is positioned between the retaining member 84 and the base 56 to bias the retaining member 84 away from the base 56. The base 56 has a handle mount 92 secured thereto. The handle mount 92 has a ramped surface 94 that extends in an arcuate path. The ramped surface 94 is engaged with a cooperating surface on the underside of the handle 82. The ramped surface 94 of the handle mount 92 and the cooperating surface on the handle 82 are configured such that, as the handle 82 is rotated from the released position to the intermediate position and from the intermediate position to the locked position, the handle 82 is moved upwardly away from the base 56 which moves the retaining member 84 upwardly towards the base 56, against biasing from the spring 90. That is, as the handle 82 is rotated towards the locked position, the retaining member 84 moves upwardly as it rotates relative to the base 56. Similarly, as the handle 82 is rotated towards the released position, the retaining member 84 moves downwardly as it rotates relative to the base 56 under biasing from the spring 90.

The retaining member 84 is structured such that, when the handle 82 is in the released position (as shown in FIG. 5), the retaining member 84 is oriented such that it is not in a position to retain the respective tool mount 50, 52 on the first track portion 44. Thus, the tool mounts 50, 52 can be freely engaged with and disengaged from the first track portion 44. That is, the retaining member 84 is oriented so that it can be lifted freely through the opening defined between the rail members 66, 68 to enable removal of the tool mounts 52, 52 and the tool thereon.

When the handle 82 is moved from the released position to the intermediate position (as shown in FIG. 6), the retaining member 84 is rotated relative to the base 56 and is moved upwardly towards the base 56. In this position, the retaining member 84 is oriented such that it retains the respective tool mount 50, 52 to the first track portion 44, but is movable along the first track portion 44. Specifically, the tool mount 50, 52 is slidable along the first track portion 44 because the retaining member 84 is spaced from or lightly engaged with the first track portion 44. However, the ends of the retaining member 84 are positioned to engage the inwardly extending flanges of the first track portion 44 to prevent upward removal of the tool mount 50, 52 with respect to the first track portion 44.

When the handle 82 is moved from the intermediate position to the locked position (as shown in FIG. 7), the retaining member 84 is further rotated relative to the base 56 and further moved upwardly towards the base 56 by the camming against ramped surface 94. This moves the ends of the retaining member 84 into forced engagement with the inwardly extending flanges of the first track portion 44. Thus, the retaining member 84 clamps the respective tool mount 50, 52 to the first track portion 44 and prevents any relative movement of the tool mount 50, 52 with respect to the first track portion 44.

When the handles 82 of the tool mounts 50, 52 are in their intermediate positions, the tool mounts 50, 52 may be moved relative to one another along the first track portion 44 so as to adjust a distance therebetween to accommodate different sized tools. Also, both tool mounts 50, 52 may be moved together along the first track portion 44 with the tool thereon. While the tool mount assembly 32, its tool mounts 50, 52, and its fasteners 60 have been described in detail, these structures may have any construction or configuration and the described embodiment is not intended to be limiting.

Figure 8:
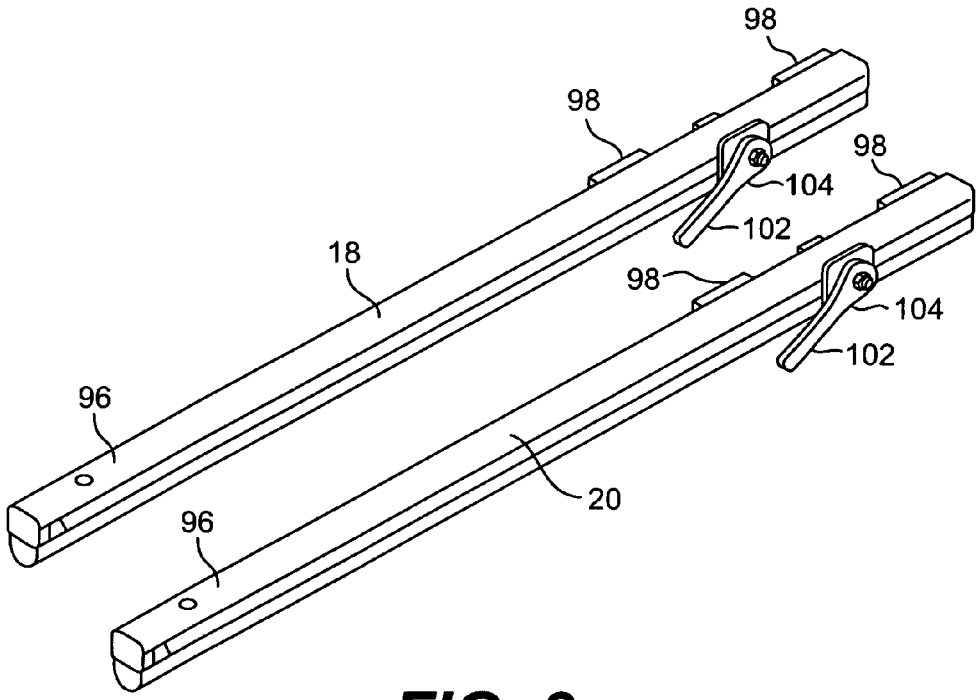
FIG. 8 is a perspective view illustrating the pair of support arms of work bench shown in FIG. 1.

FIG. 8 shows the pair of support arms 18, 20 that are movable relative to the main body 12 between a retracted position and a plurality of extended positions. One of the pair of support arms 18 is mounted to the second track portion 46 and the other of the pair of support arms 20 is mounted to the third track portion 48. In their retracted positions, the pair of support arms 18, 20 are coextensive with the main body 12, as shown in FIG. 1. In their extended positions, the free end of the support arm 18 extends outwardly from the main body 12 to the right (as viewed in FIG. 2) and the free end of the support arm 20 extends outwardly from the main body 12 to the left (as viewed in FIG. 2).

Figure 9:
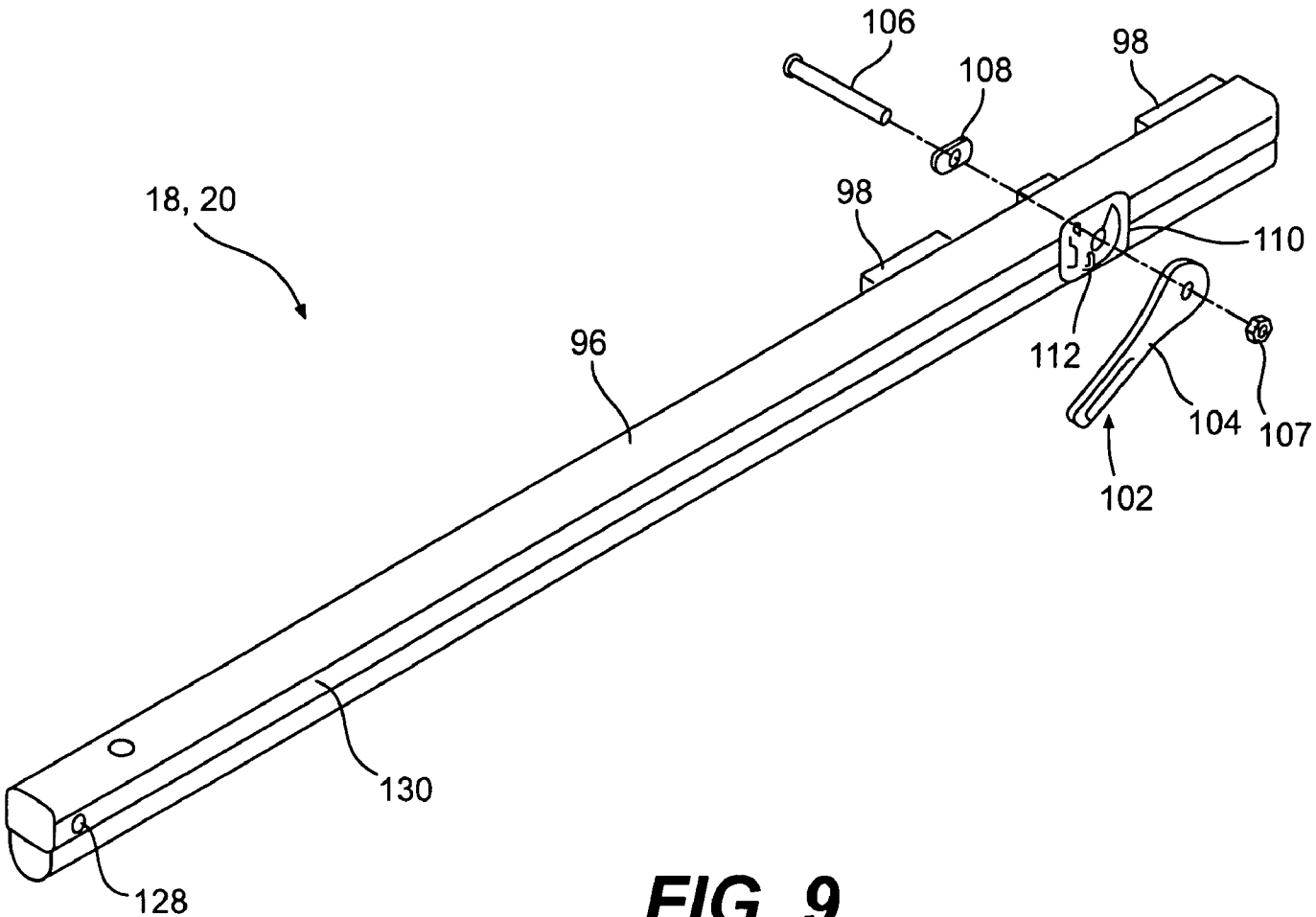
FIG. 9 is an exploded view of one of the pair of support arms shown in FIG. 8.
Figure 12:
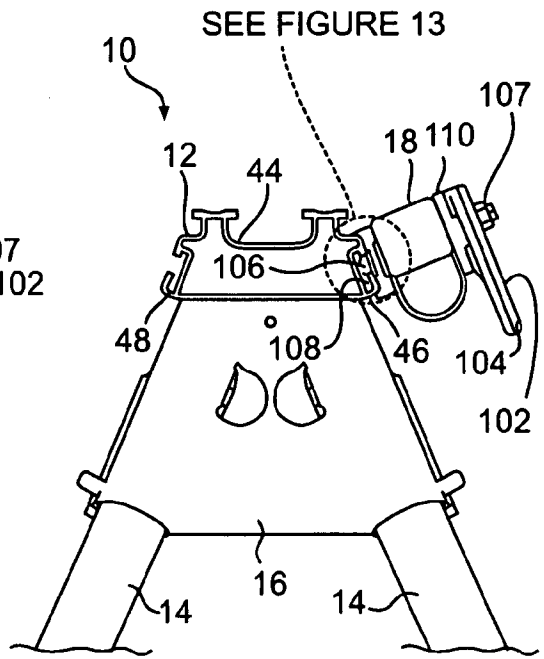
FIG. 12 is a cross-sectional view illustrating the engagement of the clamp assembly of the support arm and the main body of the work bench.
Figure 11:
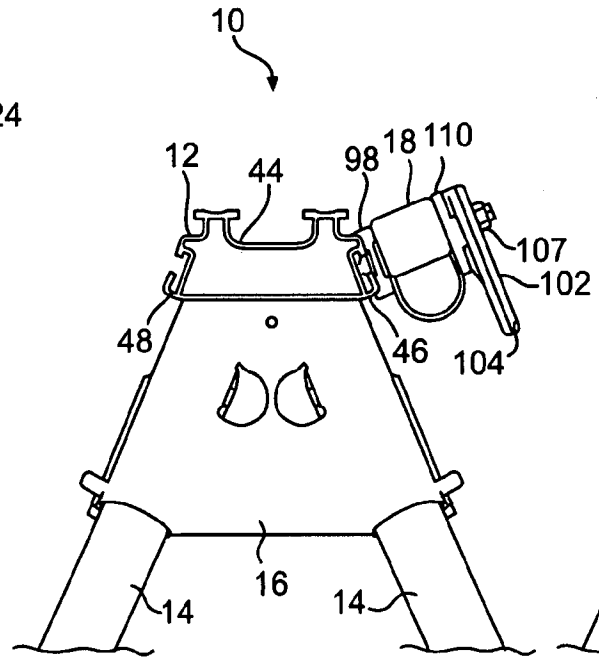
FIG. 11 is a view similar to FIG. 10 with the work support/stop assembly being removed in order to illustrate the clamp assembly of the support arm.
Figure 10:
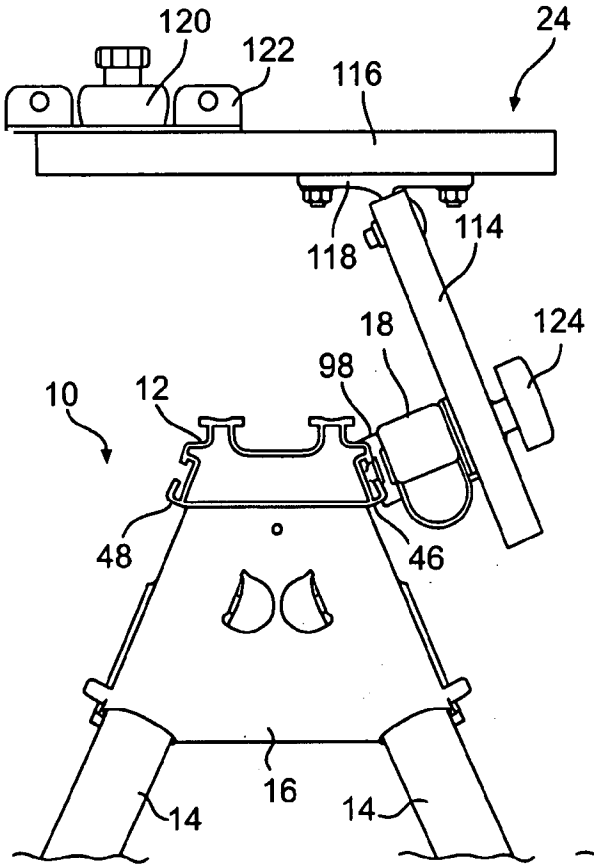
FIG. 10 is a partial cross-sectional view illustrating the engagement between the support arm and the main body of the work bench, the support arm having a work support/stop assembly attached thereto.

Each support arm 18, 20 includes an elongated tubular member 96 having a pair of mounting structures 98 secured thereto, as shown in FIG. 9. The mounting structures 98 of each support arm 18, 20 are retained in the respective track portion 46, 48 to prevent outward movement of the support arms 18, 20 away from the main body 12, but allow sliding movement of the support arms 18, 20 along the track portions 46, 48, as shown in FIGS. 10 and 11. As shown in FIGS. 1 and 2, optional end caps 100 are secured to opposing ends of the main body 12 and close off the open ends of the main body 12 and the track portions 46, 48 and thus act as end stops for the support arms 18, 20.

As shown in FIGS. 1, 2, 8, 9, 11, 12, and 14, a releasable fastener 102 is mounted to the each of the support arms 18, 20 for releasably locking the support arms 18, 20 with respect to the main body 12. The fastener 102 is in the form of a clamp assembly. Specifically, the clamp assembly 102 includes a handle 104 pivotably mounted to the tubular member 96 for movement between a released position and a locked position. In the released position, the support arms 18, 20 are slidable along the track portions 46, 48. In the locked position, the support arms 18, 20 are locked to the track portions 46, 48 to prevent any type of relative movement between the support arms 18, 20 and the main body 12. The handle 104 of the clamp assembly 102 may be manually moved between the released and locked positions to adjust and lock the support arms 18, 20 to the track portions 46, 48.

As shown in FIGS. 9 and 11–13, the handle 104 is operatively engaged with a fastener 106 to control the movement of the fastener 106 into and out of engagement with the respective track portion 46, 48. Specifically, the fastener 106 having pad 108 extends through an opening in the tubular member 96, through an opening in the handle 104, and into locking engagement with a nut 107. The tubular member 96 has a handle mount 110 secured thereto. The handle mount 110 has a ramped surface 112 that extends in an arcuate path. The ramped surface 112 is engaged with a cooperating surface on the handle 104. The ramped surface 112 of the handle mount 110 and the cooperating surface on the handle 104 are configured such that, as the handle 104 is rotated from the released position to the locked position, the handle 104 is moved outwardly away by camming action from the tubular member 96 which moves the fastener 106 and pad 108 thereof outwardly towards the tubular member 96. Similarly, as the handle 104 is rotated from the locked position to the released position, the handle 104 is moved downwardly which moves the fastener 106 and pad 108 thereof downwardly away from the tubular member 96.

Figure 13:
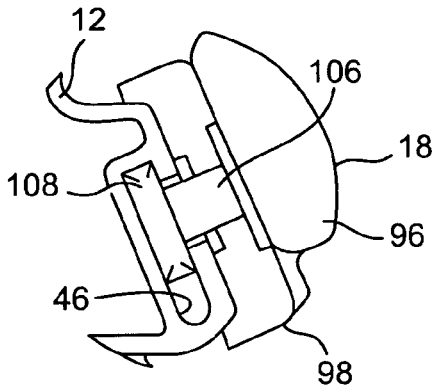
FIG. 13 is an enlarged cross-sectional view illustrating the engagement of the clamp assembly of the support arm and the main body of the work bench.

The head of the fastener 106 and pad 108 thereof are retained within the respective track portions 46, 48 (as best shown in FIG. 13) such that, when the handle 104 is in the released position, the support arms 18, 20 can be slid along the respective track portion 46, 48 because the head of fastener 106 and pad 108 thereof are spaced from or lightly engaged with the inwardly extending flanges of respective track portions 46, 48. When the handle 104 is moved from the released position to the locked position, the fastener 106 and pad 108 thereof are moved outwardly towards the tubular member 96 to force the head of fastener 106 and the pad 108 thereof into forced engagement with the inwardly extending flanges of the respective track portion 46, 48. Thus, the fastener 106 and pad 108 thereof clamp the respective support arm 18, 20 to the respective track portion 46, 48 and prevent any relative movement of the support arms 18, 20 with respect to the respective track portions 46, 48.

That is, the end of fastener 106 is threaded into threaded hole of handle 104. Threaded end of fastener 106 has a slot or geometry to mate with a device to rotate the fastener 106 for its position adjustment relative to the handle 104. A nut is used to thread onto the fastener portion extending through the handle 104 and tighten to the handle to lock the fastener adjustment. The head of fastener 106 is circular so that the fastener will freely rotate with the handle after adjustment is locked. Pad 108 has a circular recess to mate with the fastener and disperse fastener loading to track portions 46, 48 due to its increased surface area. Pad geometry allows sliding through track portions 46, 48 but also allows relative rotation of the fastener 106.

Figure 15:
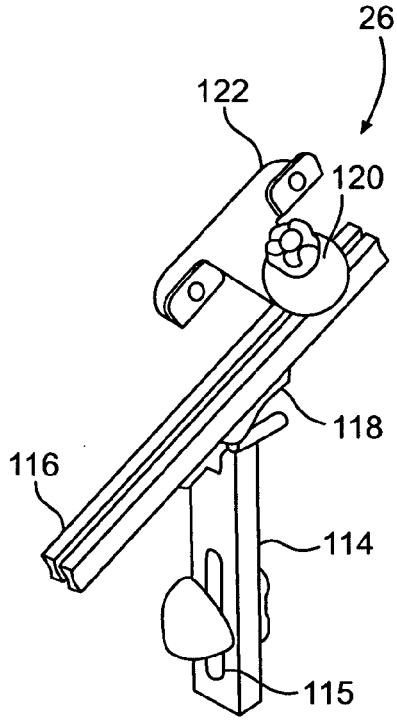
FIG. 15 is a perspective view of an embodiment of a work support/stop assembly structured for attachment to the support arm.
Figure 14:
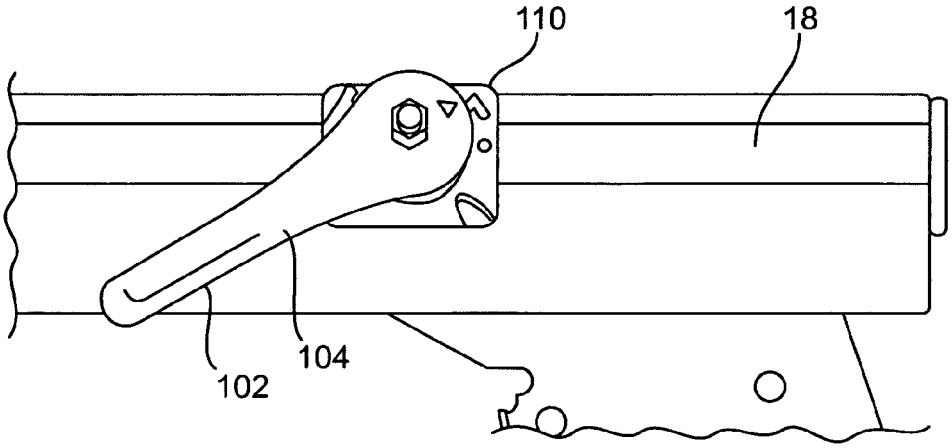
FIG. 14 is a side view illustrating the clamp assembly of the support arm.
Figure 16:
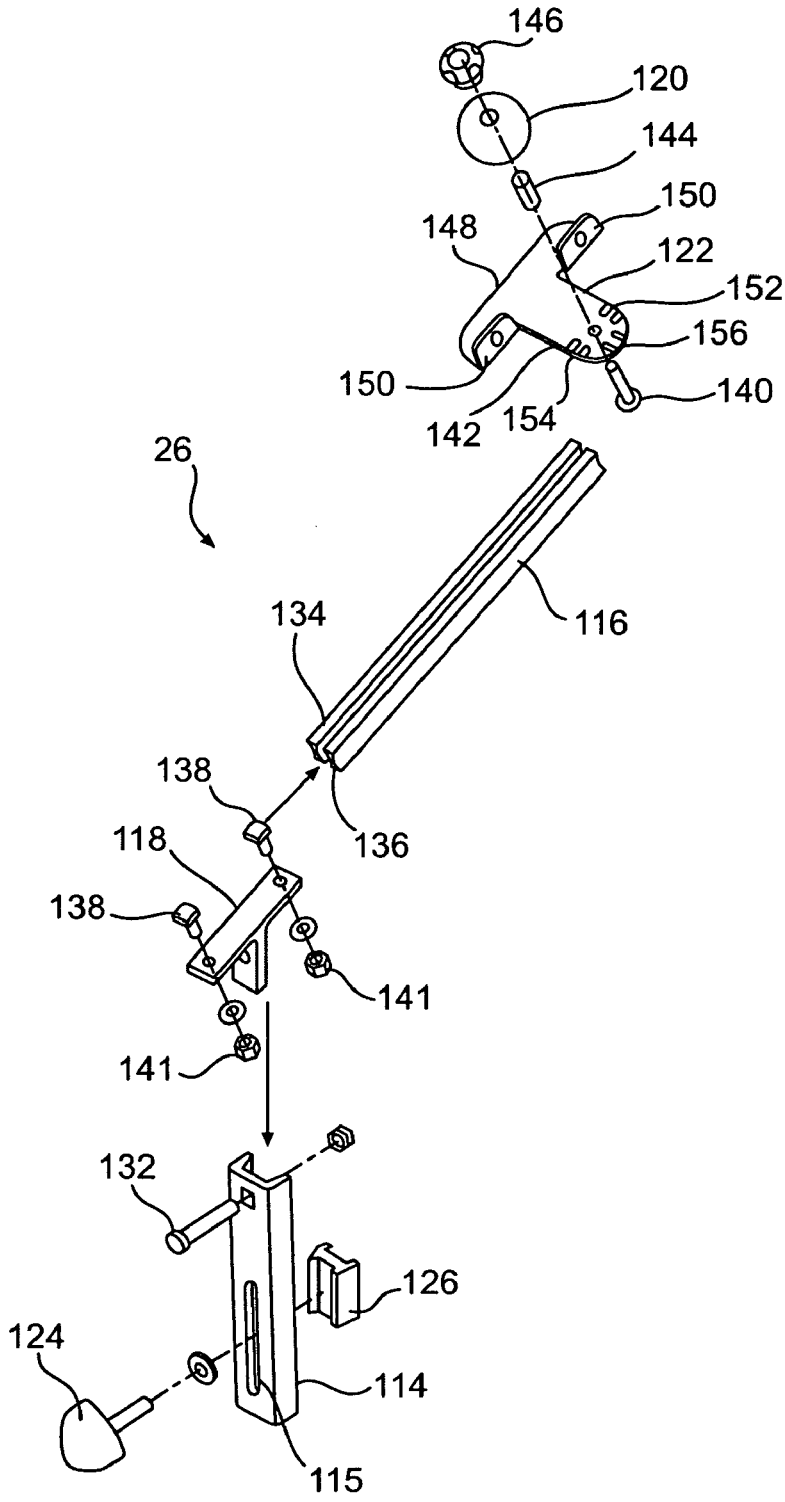
FIG. 16 is an exploded view of the work support/stop assembly shown in FIG. 15.

As shown in FIGS. 1 and 2, an adjustable work support/stop assembly 26 is mounted on the support arm 20. As shown in FIGS. 15 and 16, the work support/stop assembly 26 includes a support extension 114, a support beam 116, and a connector 118 to interconnect the support extension 114 and support beam 116. A roller 120 and a stop plate 122 are movably mounted to the support beam 116.

As shown in FIG. 16, the support extension 114 includes an elongated slot 115. A fastener 124 having a manually engagable knob extends through the slot 115, through a support adapter 126, and into a cooperating threaded opening 128 (e.g., see FIG. 9) provided on the free end of the support arm 20. The support adapter 126 is structured to cradle a protrusion 130 (e.g., see FIG. 9) provided on the support arm 20 so as to prevent relative movement between the support arm 20 and the support adapter 126, and hence the support extension 114. The fastener 124 is easily manipulated by the knob thereof to remove the fastener 124 and hence the work support/stop assembly 26 from the support arm 20 for storage purposes. Also, the fastener 124 may be loosened from the support arm 20 to allow the support extension 114 to move relative to the support adapter 126, so as to adjust the height of the support extension 114 with respect to the support arm 20.

The connector 118 is generally T-shaped with the lower leg thereof mounted to the end of the support extension 114 by a fastener 132. The crossing leg of the T-shaped connector 118 supports the support beam 116.

As shown in FIG. 16, the support beam 116 has a general H-shape that defines an upper track portion 134 and a lower track portion 136. The side walls of the upper track portion 134 have inwardly extending flanges and the side walls of the lower track portion 136 have inwardly extending flanges. A pair of fasteners 138 secure the support beam 116 to the crossing leg of the connector 118. Specifically, the heads of the fasteners 138 are retained in the lower track portion 136 by the inwardly extending flanges thereof. The threaded shafts of the fasteners 138 extend through respective openings in the connector 118 and into threaded engagement with a respective nut 141.

Also, a fastener 140 is retained in the upper track portion 134 for securing the roller 120 and the stop plate 122. Specifically, the head of the fastener 140 is retained in the upper track portion 134 by the inwardly extending flanges thereof. The threaded shaft of the fastener 140 extends through an opening in the leg 142 of the stop plate 122, through a bushing 144 that rotatably supports the roller 120, and into threaded engagement with a manually engagable knob 146.

The stop plate 122 is movable with respect to the support beam 116. This enables the stop plate 122 to be moved between a stop/support position or a withdrawn position to allow use of the roller 120. The stop plate 122 includes a bottom wall 148 having a leg 142 and a pair of spaced apart side walls 150, as shown in FIG. 16. The leg 142 of the stop plate 122 has bent portions 152, 154, 156 structured to prevent relative movement between the stop plate 122 and support beam 116. In use, the bent portions 152, 154 extend between the inwardly extending flanges of the upper track portion 134 to secure the stop plate 122 with respect to the support beam 116 such that the spaced apart side walls 150 extend generally parallel with the support beam 116. Also, the stop plate 122 may be rotated so that the bent portion 156 extends between the inwardly extending flanges of the upper track portion 134 to secure the stop plate 122 with respect to the support beam 116 such that the spaced apart side walls 150 extend generally transverse to the support beam 116. These bent portions 152, 154, 156 may be provided by other structure, such as separately attached structures, and one or more of them may be omitted.

In use, the support beam 116 is capable of supporting an item, such as a long piece of lumber, thereon in an elevated position so that the item is generally horizontal for being acted upon (e.g., cut, drilled, etc.) by the tool on the tool mount assembly 32. That is, the support beam 116 enables the item to be elevated at a height which corresponds to the height of the working surface of the tool mounted on the tool mount assembly 32. For example, where the tool is a mitre or chop saw, the support beam 116 would be positioned so that its surface is at the same height of the support surface of the saw.

When the roller 120 is positioned forward of the stop plate 122, the roller 120 is positioned to line up the item with the tool and facilitate movement of the item relative to the support beam 116. That is, the roller 120 rotatably engages the item so as to align the item with the tool so that an accurate cut, or other procedure, can be made. The position of the roller 120 with respect to the support beam 116 can be adjusted by loosening the knob 146 and sliding the roller 120 along the upper track portion 134 (i.e., laterally relative to the main body 12) to the desired position. Also, the height of the support beam 116 can be adjusted to a desired height (i.e., vertically relative to the main body 12) by adjusting the support extension 114 via the fastener 124. Moreover, the distance of the support beam 116 and roller 120 from the tool can be adjusted by adjusting the position of the support arm 20 longitudinally with respect to the main body 12 via the clamp assembly 102.

When the stop plate 122 is positioned forward of the roller 120, the stop plate 122 is positioned to act as a rigid guide or as a stop member. That is, the stop plate 122 may be positioned such that the side walls 150 thereof engage the item so as to align the item with the tool. Alternatively, the stop plate 122 may be positioned such that the side walls 150 engage the end of the item during cutting, or other procedure, so as to establish cutting lengths, for example. For example, where the tool is a saw, such as a mitre or chop saw, if the user needs to cut a series of boards to the same length, the stop plate 122 can be positioned at that length from the saw blade, and then the user can abut the boards against the stop plate so that each board is cut to the same length. Similar to the roller 120, the position of the stop plate 122 with respect to the support beam 116 can be adjusted by loosening the knob 146 and sliding the stop plate 122 along the upper track portion 134 to the desired position. Moreover, the height of the support beam 116 and distance from the tool can be adjusted via the fastener 124 and clamp assembly 102, respectively.

Thus, the adjustable work support/stop assembly 26 is provided for supporting and/or stopping items to be cut by the tool, such as lumber. However, this assembly 26 may have any construction and the example described herein is not intended to be limiting.

As shown in FIGS. 1 and 2, an adjustable work support assembly 24 is mounted on the support arm 18. The adjustable work support assembly 24 is substantially similar to the adjustable work support/stop assembly 26. However, the adjustable work support assembly 24 does not include a stop plate 122. Thus, the adjustable work support assembly 24 is structured to line up an item with the tool and facilitate movement of the item relative to the support beam 116 thereof. However, the work support assembly 24 may include a support plate 122 to act as a stop or rigid guide, if desired, and may have any other construction or configuration.

Figure 17:
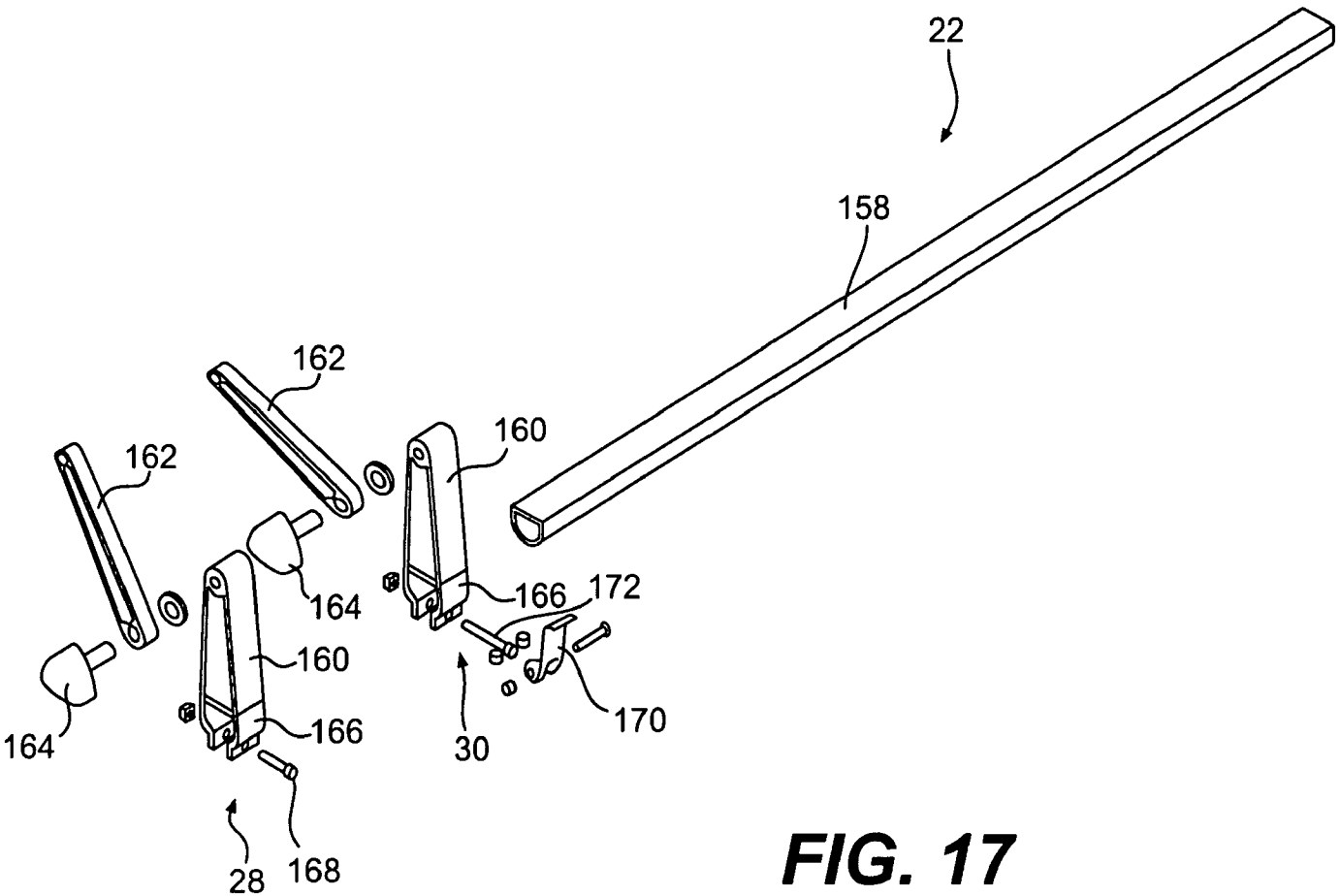
FIG. 17 is an exploded view illustrating the adjustable stop arm of the work bench shown in FIG. 1 and a pair of flip stop assemblies structured for attachment to the adjustable stop arm.

FIG. 17 shows the adjustable stop arm 22 that is movable relative to the support arm 20 between a retracted position and a plurality of extended positions. In the illustrated embodiment, the adjustable stop arm 22 is telescopically mounted to the support arm 20 such that, in the retracted position, the adjustable stop arm 22 is coextensive with the main body 12, as shown in FIG. 1. In the extended positions, the free end of the adjustable stop arm 22 extends outwardly from the support arm 20 to the left (as viewed in FIG. 2).

The adjustable stop arm 22 includes an elongated tubular member 158 that is received within a lower tubular portion of the tubular member 96 of the support arm 20. A pair of flip stop assemblies 28, 30 are mounted on the adjustable stop arm 22. As shown in FIG. 17, each flip stop assembly 28, 30 includes a support extension 160, a stop beam 162, and a releasable fastener 164 to interconnect the support extension 160 and stop beam 162.

As illustrated, one end of the support extension 160 includes a clamping structure 166 structured to stably support the support extension 160 in an upright position on the adjustable stop arm 22. The interior of the clamping structure 166 has a shape that mates or keeps to the exterior of the member 158 to prevent rotation of the support extension 160. The opposite end of the support extension 160 is structured to pivotally mount the stop beam 162. Specifically, the fastener 164, having a manually engagable knob, extends through one end of the stop beam 162 and into a cooperating threaded opening provided on the opposite end of the support extension 160 to secure the stop beam 162 to the support extension 160. The fastener 164 can be manually loosened by the knob to allow the stop beam 162 to pivot relative to the support extension 160.

The clamping structure 166 is structured to allow the support extension 160 and hence the stop beam 162 to slide along the adjustable stop arm 22. In the flip stop assembly 28, a fastener 168 extends through a bottom portion of the clamping structure 166 to tighten the clamping structure 166 and hence releasably secure the flip stop assembly 28 to the adjustable stop arm 22. In the flip stop assembly 30, a toggle 170 is operatively connected with a fastener 172 so that the clamping structure 166 can be easily manually tightened/released so as to releasably secure the flip stop assembly 30 to the adjustable stop arm 22. When released, the flip stop assemblies 28, 30 can be moved along the adjustable stop arm 22 to a desired position. It is contemplated that both flip stop assemblies 28, 30 have toggled fasteners or that both flip stop assemblies 28, 30 have fasteners without toggles.

In use, the flip stop assemblies 28, 30 function to accurately set the length for multiple items to be cut by the tool, such as lumber, without having to repeatably measure and mark the items. The adjustable stop arm 22 is simply adjusted with respect to the support arm 20, and the support arm 20 is adjusted with respect to the main body 12, to position the flip stop assemblies 28, 30 at desired lengths from the tool. Also, the flip stop assemblies 28, 30 can be adjusted with respect to the adjustable stop arm 22. The item to be cut is engaged with the stop beam 162 of the respective flip stop assembly 28, 30 for cutting a predetermined length. A pair of flip stop assemblies 28, 30 are provided on the adjustable stop arm 22 to allow for cutting two desired lengths. However, only one flip stop assembly may be provided or more than two flip stop assemblies may be provided to allow for cutting any number of desired lengths. For example, where the tool is a saw, such as a mitre or chop saw, if the user needs to cut a series of boards to two different lengths, the flip stop assembly 28 can be positioned at one of the lengths from the saw blade and the flip stop assembly 30 can be positioned at the other of the lengths from the saw blade, and then the user can abut the boards against the desired flip stop assembly 28, 30 so that each board is cut to the desired length. While the flip stop assemblies 28, 30 have been described in detail, they may have any construction and the examples described herein are not intended to be limiting.

The work bench 10 enables its user to efficiently handle a relatively long item, such as a long piece of lumber. For example, as shown in FIG. 2, by placing the tool mount assembly 32 in the middle of the main body 12, with the pair of support arms 18, 20 in extended positions and the adjustable stop arm 22 in an extended position, the work support assembly 24, work support/stop assembly 26, and flip stop assemblies 28, 30 are positioned such that the user of the work bench 10 can use the tool to cut, drill, etc. a relatively long item.

Figure 18:
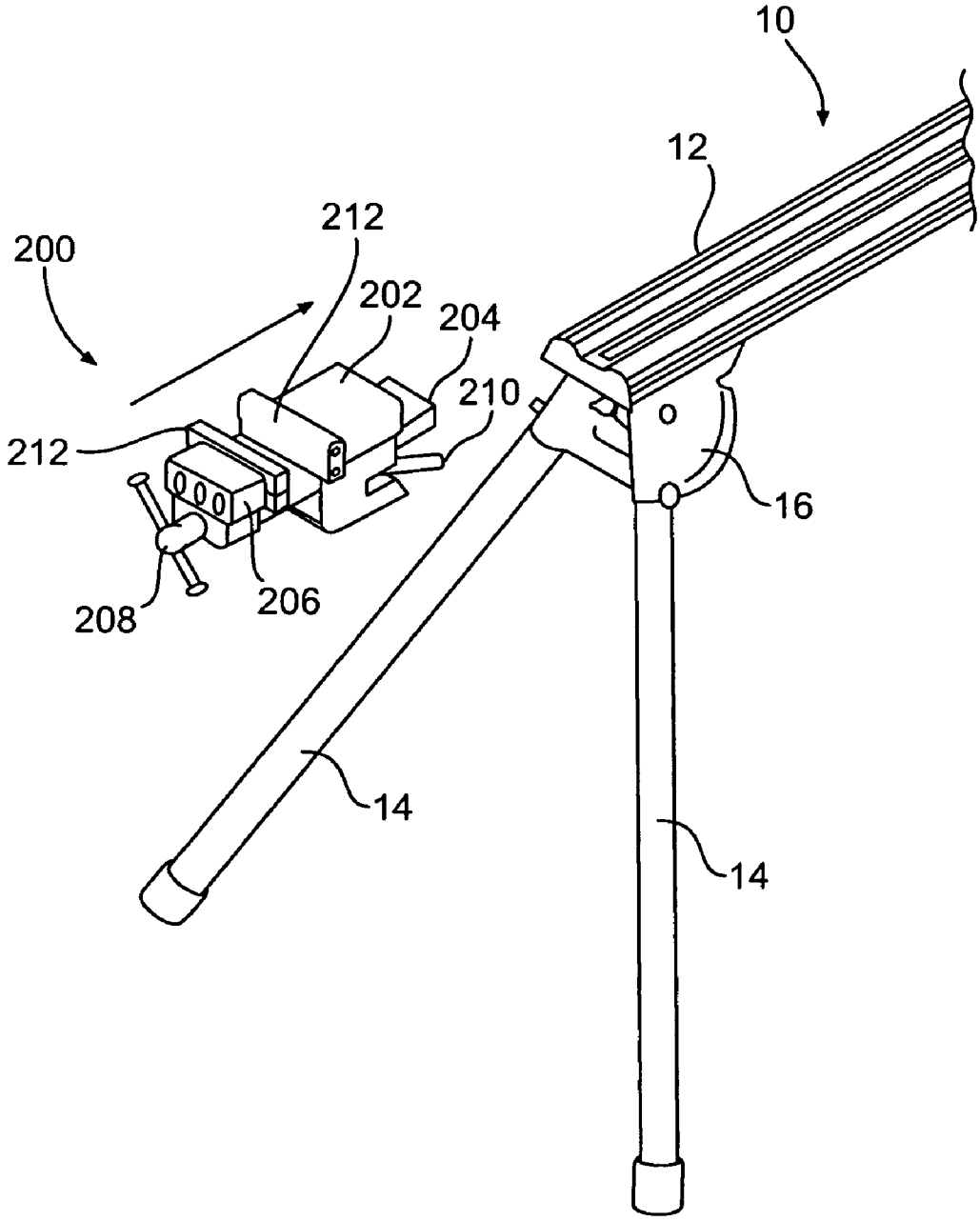
FIG. 18 is a perspective view of an embodiment of a vise structured for use with the work bench shown in FIG. 1.
Figure 19:
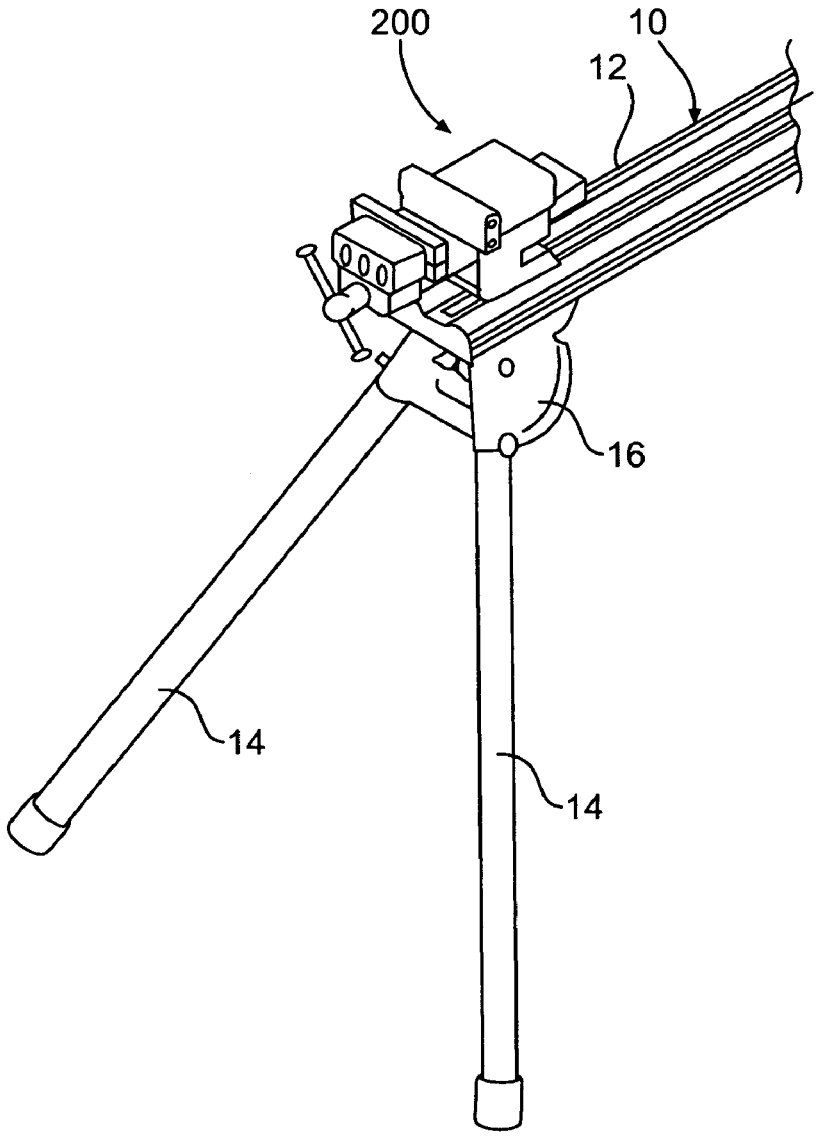
FIG. 19 is a perspective view of the vise shown in FIG. 18 engaged with the main body of the work bench shown in FIG. 1 such that the vise extends generally parallel with the main body.
Figure 20:
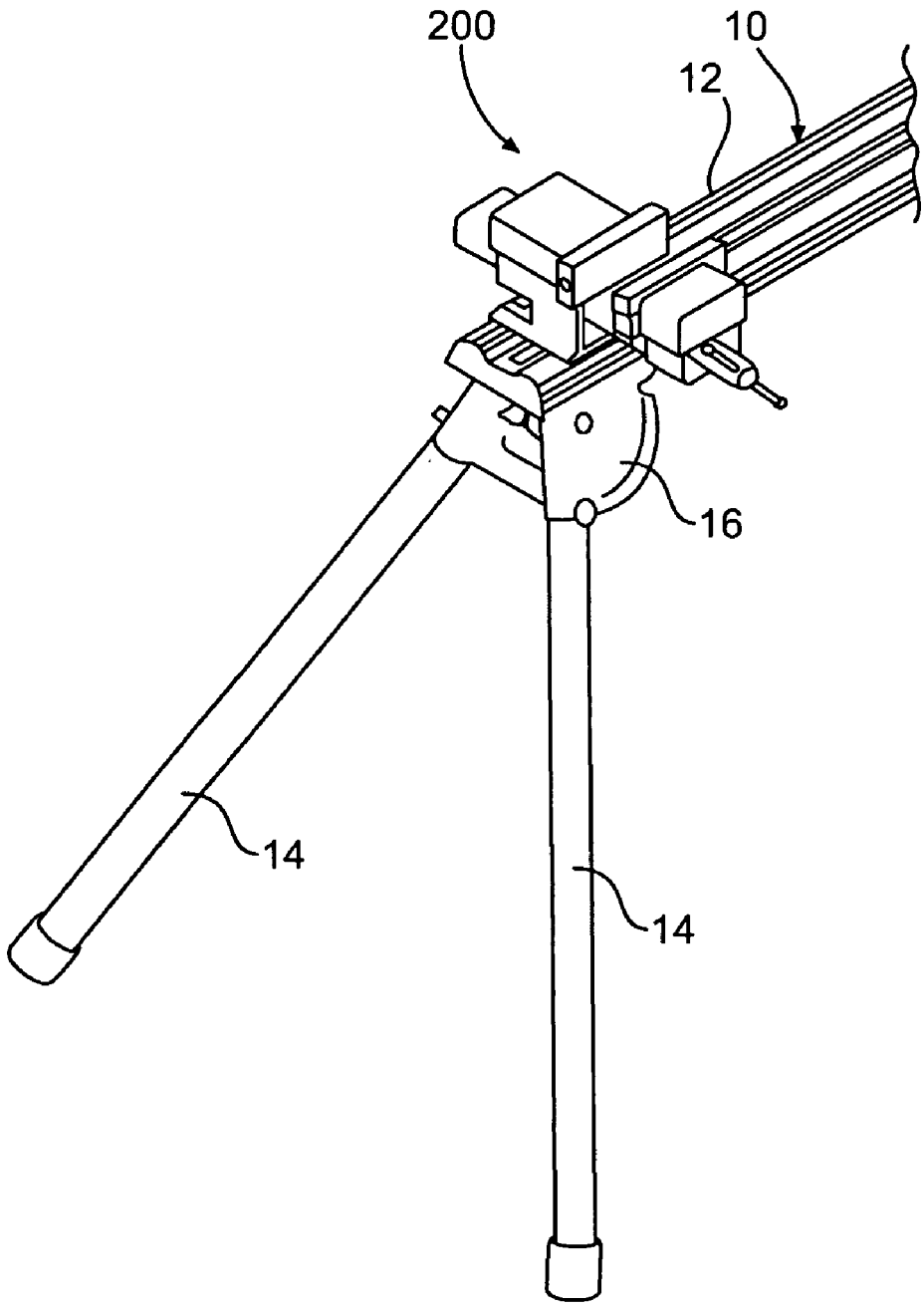
FIG. 20 is a perspective view of the vise shown in FIG. 18 engaged with the main body of the work bench shown in FIG. 1 such that the vise extends generally transverse to the main body.
Figure 22:
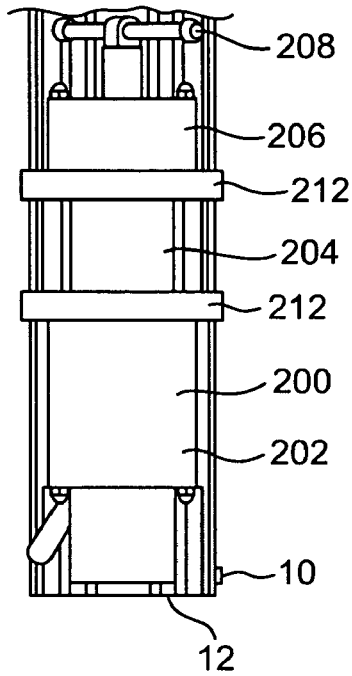
FIG. 22 is a top view of the vise shown in FIG. 18 engaged with the main body of the work bench shown in FIG. 1 such that the vise extends generally parallel with the main body.
Figure 25:
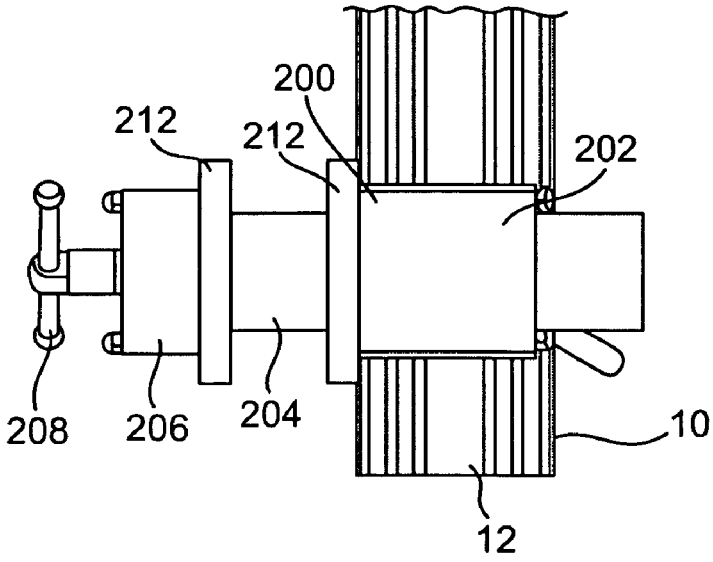
FIG. 25 is a top view of the vise shown in FIG. 18 engaged with the main body of the work bench shown in FIG. 1 such that the vise extends generally transverse to the main body.

FIG. 18 illustrates a vise 200 that may be mounted onto the work bench 10. The vise 200 is structured so that it may be engaged with the first track portion 44 of the work bench 10 in two positions. Specifically, the vise 200 may be mounted to the first track portion 44 in a first position where it can hold items generally transverse to the work bench 10 (as shown in FIGS. 19 and 22). Alternatively, the vise 200 may be mounted to the first track portion 44 in a second position where it can hold items generally parallel to the work bench 10 (as shown in FIGS. 20 and 25).

Figure 21:
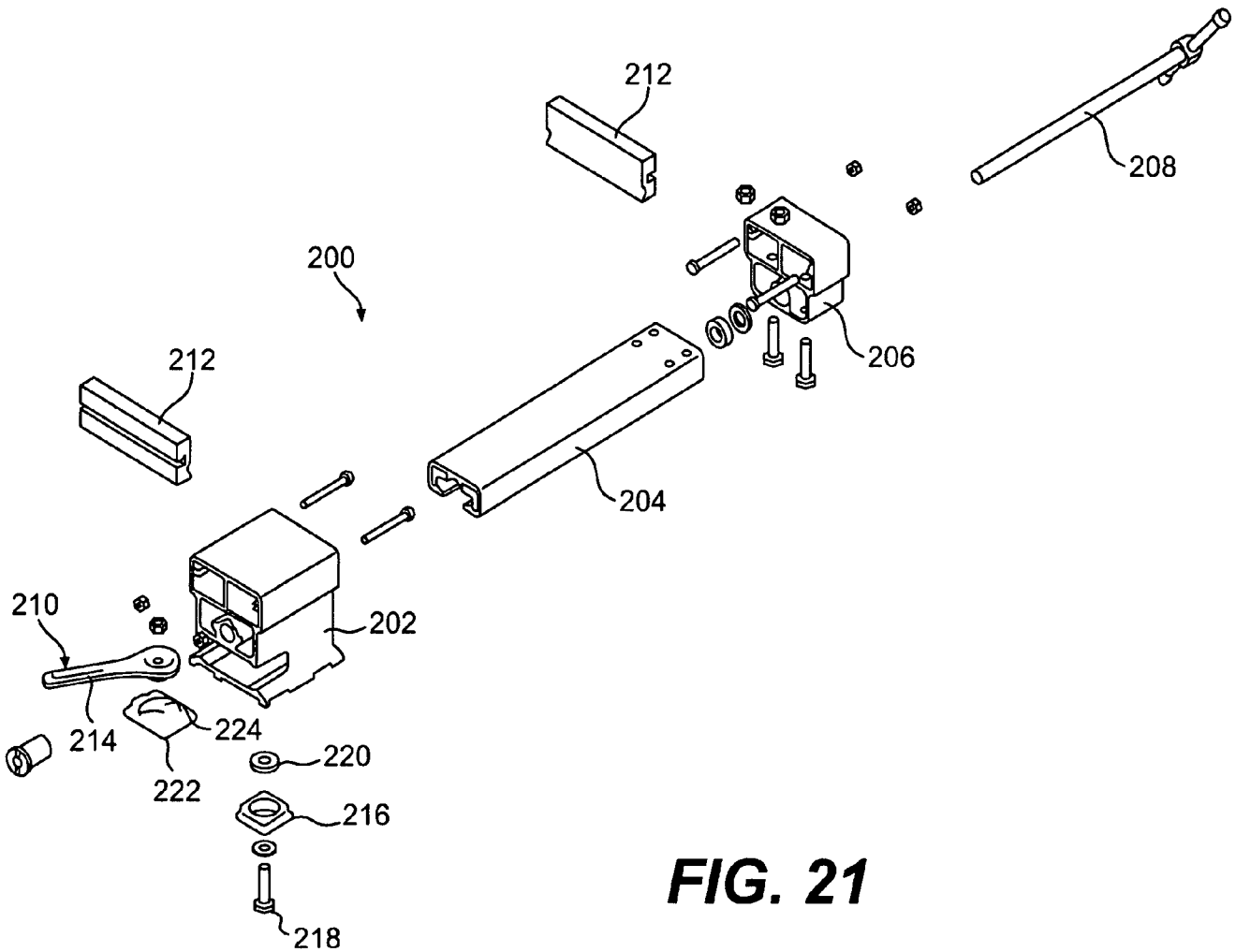
FIG. 21 is an exploded view of the vise shown in FIG. 18.

As shown in FIGS. 18 and 21, the vise 200 includes a base 202, an extension 204 slidably engaged with the base 202, a support 206 mounted to the extension 204, a handle 208, and a clamp assembly 210. The handle 208 extends through the extension 204 and into threaded engagement with the base 202. As is conventional, rotation of the handle 208 moves the extension 204 and the support 206 thereof towards and away from the base 202. The base 202 and the support 206 each have an engagement plate 212 secured thereto that is structured to engage the item to be clamped therebetween.

Figure 23:
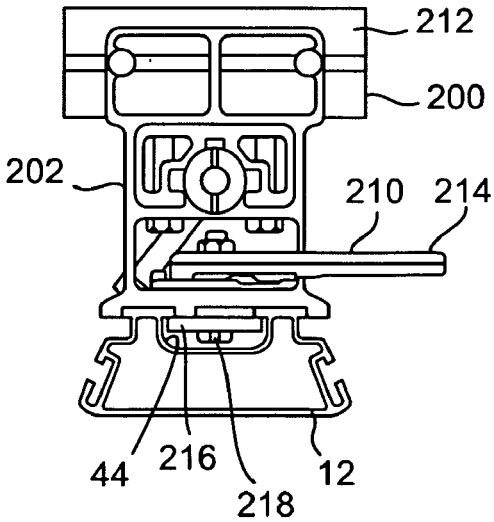
FIG. 23 is a cross-sectional view illustrating the vise engaged with the main body of the work bench with the vise extending generally parallel with the main body, a clamp assembly of the vise in a released position.
Figure 26:
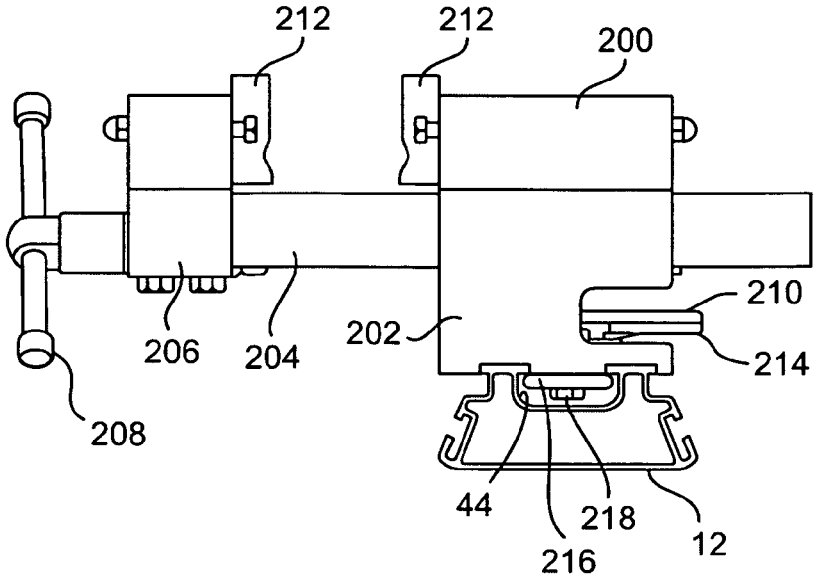
FIG. 26 is a cross-sectional view illustrating the vise engaged with the main body of the work bench with the vise extending generally transverse to the main body, a clamp assembly of the vise in a released position.

The base 202 is structured such that, when the vise 200 is mounted in the first position to hold items generally transverse to the work bench 10 (as shown in FIG. 23), lateral flanges of the base 202 operatively engage the first and second rail members 66, 68 of the first track portion 44 to permit sliding movement of the base 202 longitudinally along the first track portion 44 but prevent lateral movement of the base 202 with respect to the first track portion 44. The base 202 is also structured such that, when the vise 200 is mounted in the second position to hold items generally parallel to the work bench 10 (as shown in FIG. 26), lateral flanges of the base 202 operatively engage the first and second rail members 66, 68 of the first track portion 44 to permit sliding movement of the base 202 longitudinally along the first track portion 44 but prevent lateral movement of the base 202 with respect to the first track portion 44.

Figure 24:
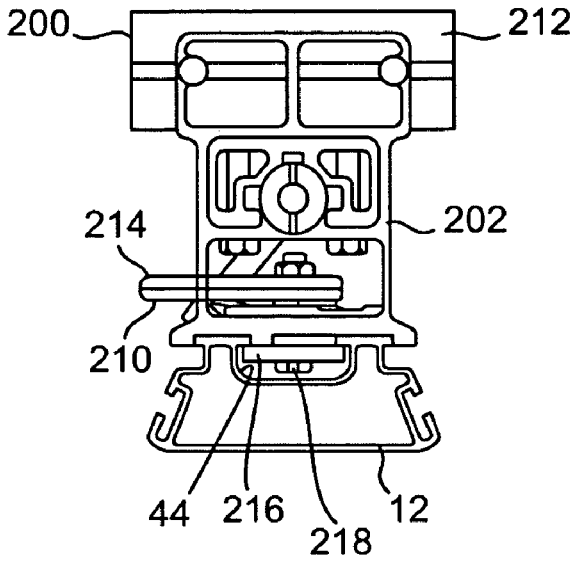
FIG. 24 is a view similar to FIG. 23 illustrating the clamp assembly of the vise in a locked position.
Figure 27:
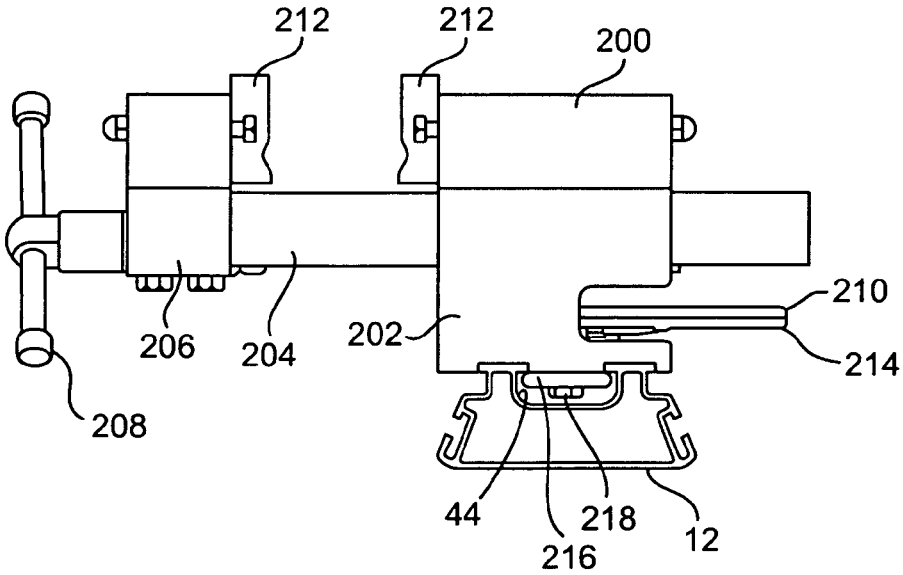
FIG. 27 is a view similar to FIG. 26 illustrating the clamp assembly of the vise in a locked position.

The clamp assembly 210 is structured to releasably mount the vise 200 to the first track portion 44. Specifically, the clamp assembly 210 includes a handle 214 pivotably mounted to the base 202 for movement between a released position (as shown in FIGS. 23 and 26) and a locked position (as shown in FIGS. 24 and 27). When the handle 214 is in the released position, the vise 200 may be engaged with the first track portion 44, removed from the first track portion 44, and slidable along the first track portion 44. When the handle 214 is in the locked position, the vise 200 is locked to the first track portion 44 to prevent any type of relative movement between the vise 200 and the first track portion 44. The handle 214 of the clamp assembly 210 may be manually moved between the released and locked positions to remove, adjust, and mount the vise 200 to the first track portion 44.

The handle 214 is operatively engaged with a retaining member 216 to control the movement of the retaining member 216 into and out of engagement with the first track portion 44. Specifically, a fastener 218 extends through an opening in the retaining member 216, through an opening in the base 202, through an opening in the handle 214, and into locking engagement with a nut.

A spring 220 is positioned between the retaining member 216 and the base 202 to bias the retaining member 216 away from the base 202. The base 202 has a handle mount 222 secured thereto. The handle mount 222 has a ramped surface 224 that extends in an arcuate path. The ramped surface 224 is engaged with a cooperating surface on the handle 214. The ramped surface 224 of the handle mount 222 and the cooperating surface on the handle 214 are configured such that, as the handle 214 is rotated from the released position to the locked position, the handle 214 is moved upwardly away from the base 202 by a camming action which moves the retaining member 216 upwardly towards the base 202 against biasing from the spring 220. Similarly, as the handle 214 is rotated from the locked position to the released position, the handle 214 is moved downwardly towards the base 202 which moves the retaining member 216 downwardly away from the base 202 with biasing from the spring 220.

The retaining member 216 is oriented such that the vise 200 must be slid onto the end of the first track portion 44 of the work bench 10. That is, the vise 200 cannot be mounted from above because the ends of the retaining member 216 are positioned to engage the inwardly extending flanges of the first track portion 44. However, the same type of mounting as described above for the supports 50, 52 may be used for the vise if desired.

After the vise 200 is engaged with the first track portion 44 in either the first position as shown in FIG. 22 or the second position as shown in FIG. 25, the retaining member 216 is structured such that, when the handle 214 is in the released position (as shown in FIGS. 23 and 26), the retaining member 216 is positioned such that it is spaced from or lightly engaged with the inwardly extending flanges of the first track portion 44. Thus, the vise 200 can be freely engaged with the first track portion 44, removed from the first track portion 44, or slid along the first track portion 44 to a desired position. When the handle 214 is moved from the released position to the locked position (as shown in FIGS. 24 and 27), the handle 214 is moved upwardly which moves the retaining member 216 upwardly towards the base 202 and into forced engagement with the inwardly extending flanges of the first track portion 44. Thus, the retaining member 216 clamps the vise 200 to the first track portion 44 and prevents any relative movement of the vise 200 with respect to the first track portion 44.

More than one vise 200 may be mounted to the first track portion 44 that cooperate with one another in rigidly supporting an item. The first track portion 44 perfectly aligns the vises 200 with one another, which facilitates using two vises 200 in tandem.

Also, the vise 200 may have any construction and the example described herein is not intended to be limiting.

Figure 28:
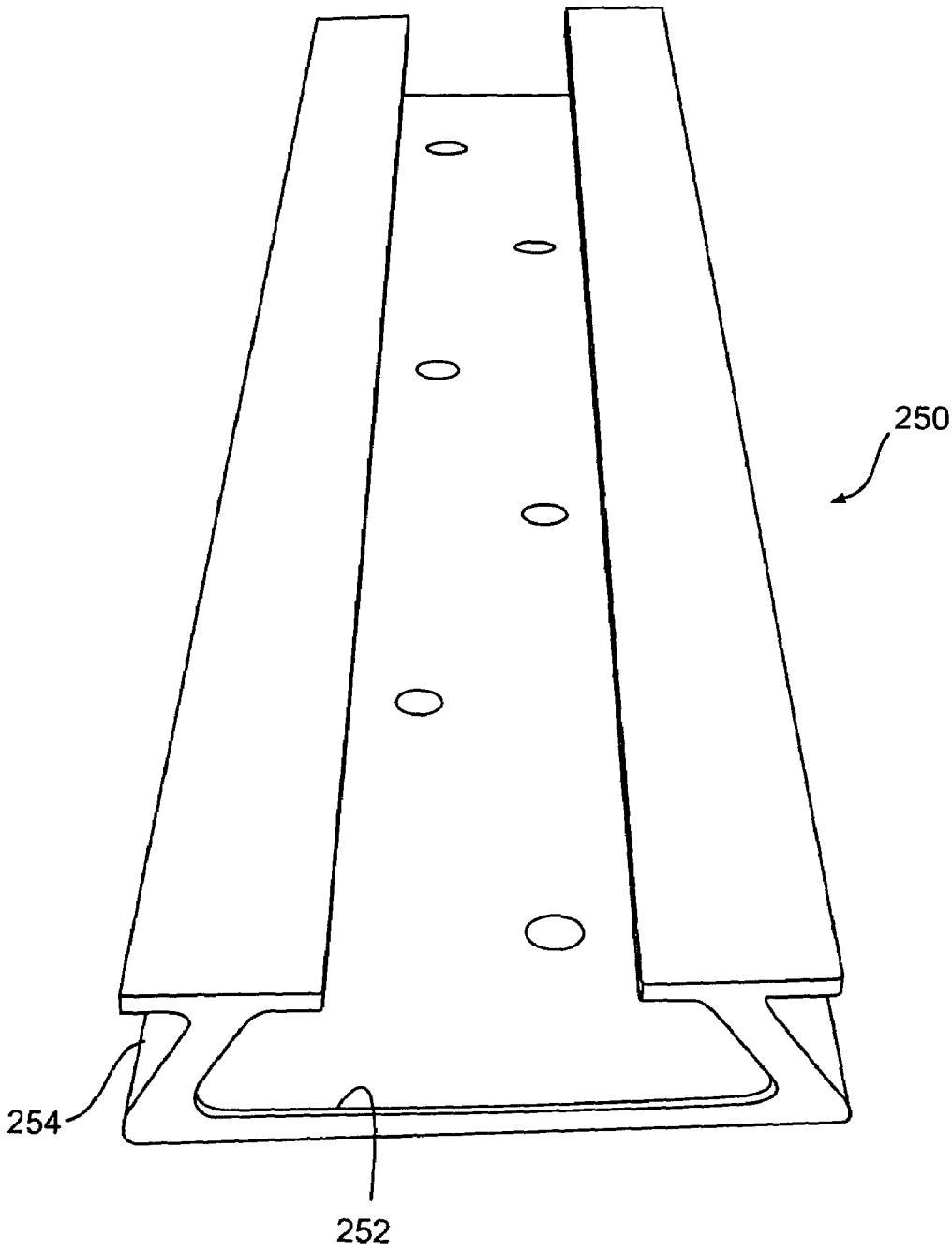
FIG. 28 is a perspective view of an additional main body structured to adapt the vise shown in FIG. 18 to a work bench or other work surface.
Figure 29:
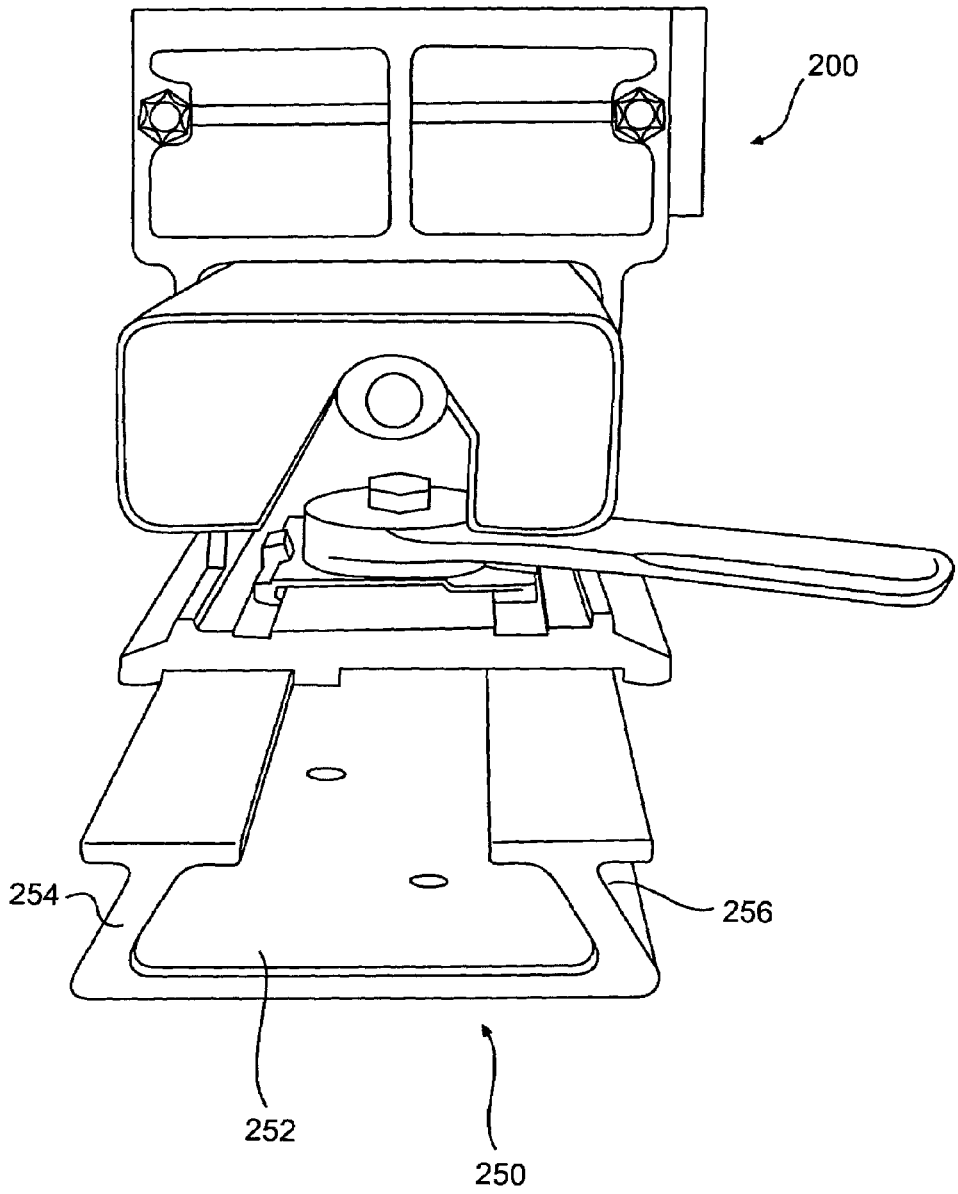
FIG. 29 is a perspective view of the vise shown in FIG. 18 mounted to the additional main body shown in FIG. 28.

As shown in FIGS. 28 and 29, an additional main body 250 may be provided that is attachable with conventional fasteners to a work table or a tailgate of a truck, for example. The main body 250 may be attachable to any suitable location on an automobile for use in any suitable automotive application. As illustrated, the length of the additional main body 250 is substantially less than the length of the main body 12. However, the additional main body 250 may have any suitable length.

As best shown in FIG. 28, the main body 250 includes a track portion 252 having first and second rail members 254, 256 each having inwardly and outwardly extending flanges. The additional main body 250 has a similar configuration as the first track portion 44 of the main body 12 so that the tool mounts 50, 52 and vise 200 may be used with either the first track portion 44 on the work bench 10 or the track portion 252 of the main body 250 (e.g., as shown in FIG. 29) mountable to, e.g., a work table/tailgate of a truck. Moreover, the vise 200 can be mounted to the track portion 252 of the additional main body 250 in two positions, namely a first position wherein it can hold items transverse to the additional main body 250, and a second position where it can hold items parallel to the additional main body 250.

FIGS. 30–47 illustrate another embodiment of a vise 300. In this embodiment, the vise 300 is structured such that it may be mounted from above onto the work bench 10 or the additional main body 250. Similar to the vise 200, the vise 300 can be mounted to the work bench 10 or main body 250 in two positions, namely a first position wherein it can hold items transverse to the work bench 10 or main body 250 (as shown in FIGS. 36–41), and a second position where it can hold items parallel to the work bench 10 or main body 250 (as shown in FIGS. 42–47).

Figure 30:
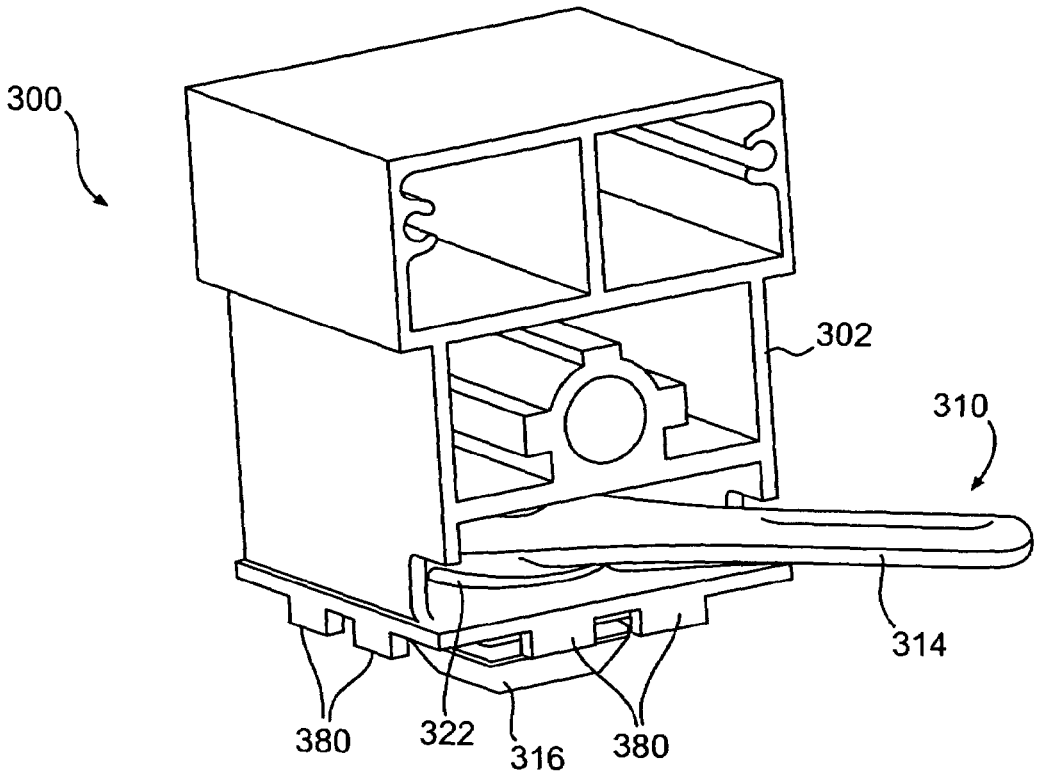
FIG. 30 is a perspective view of another embodiment of a vise structured for use with the work bench shown in FIG. 1 or the additional main body shown in FIG. 28.
Figure 31:
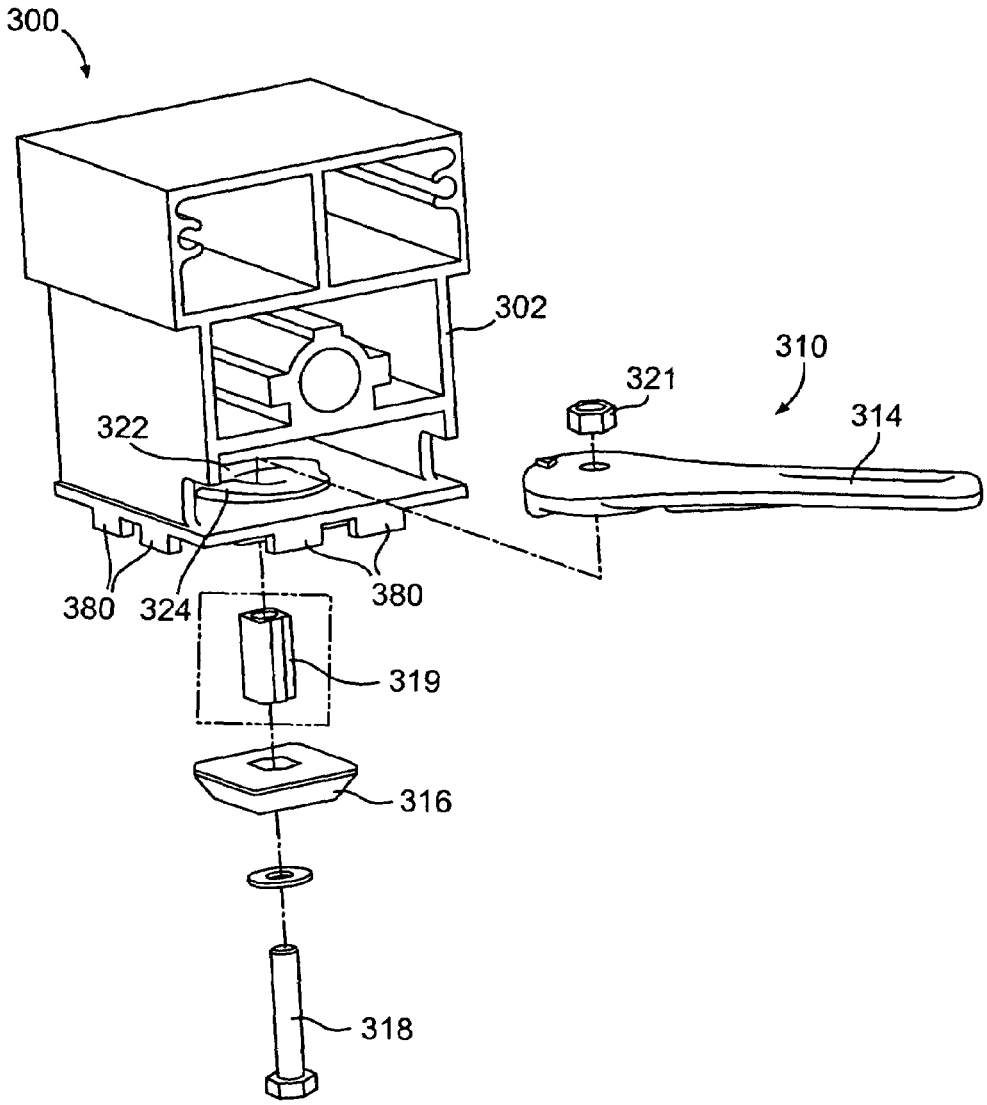
FIG. 31 is an exploded view of the vise shown in FIG. 30.
Figure 32:
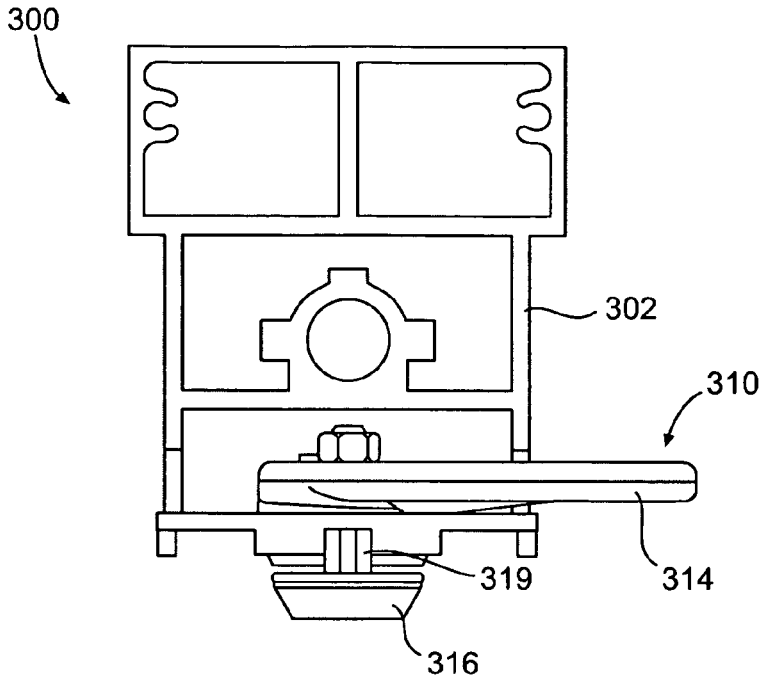
FIG. 32 is a front view of the vise shown in FIG. 30 with the clamp assembly in a released position.

As shown in FIGS. 30 and 31, the vise 300 includes a base 302 and a clamp assembly 310 structured to removably secure the vise 300 to the work bench 10 or main body 250. Although not illustrated, it should be understood that the vise 300 includes an extension, a support, a handle, and engagement plates similar to the extension 204, support 206, handle 208, and engagement plates 212 of vise 200, which are carried by the base 302.

Figure 33:
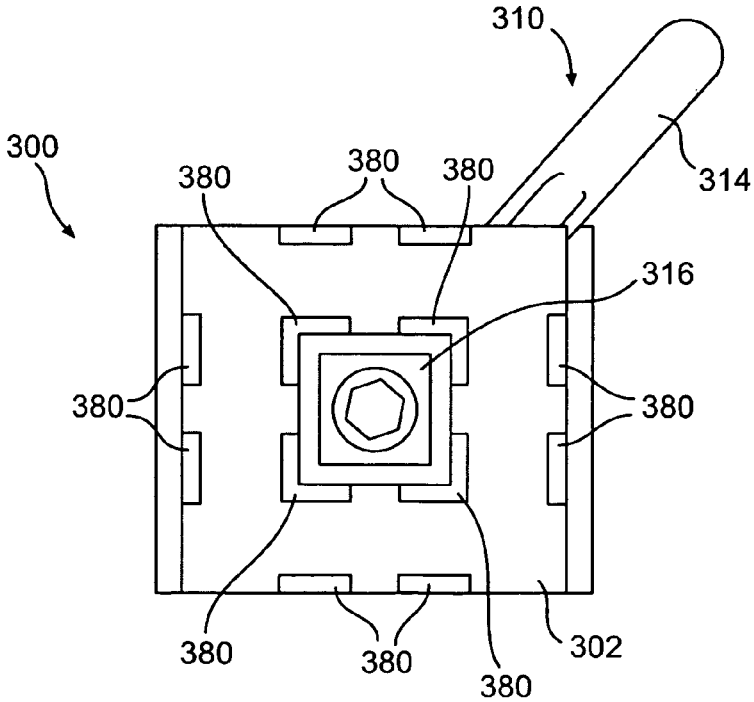
FIG. 33 is a bottom view of the vise shown in FIG. 32.
Figure 34:
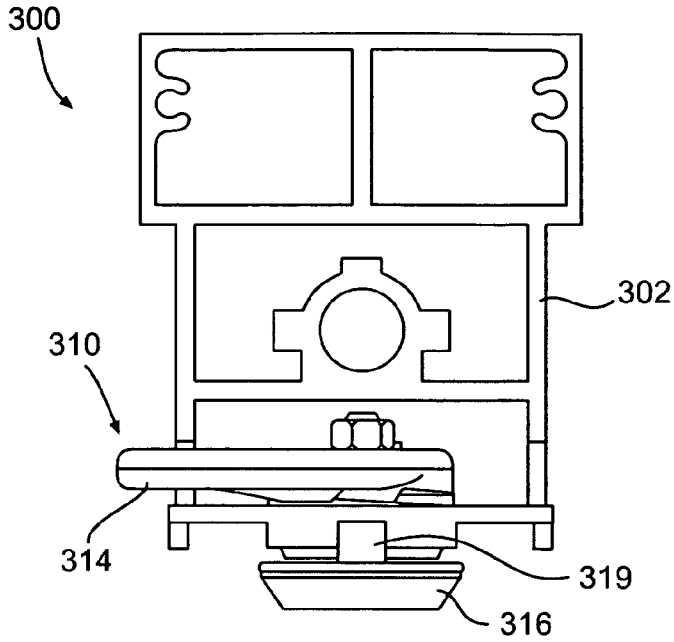
FIG. 34 is a front view of the vise shown in FIG. 30 with the clamp assembly in a locked position.
Figure 35:
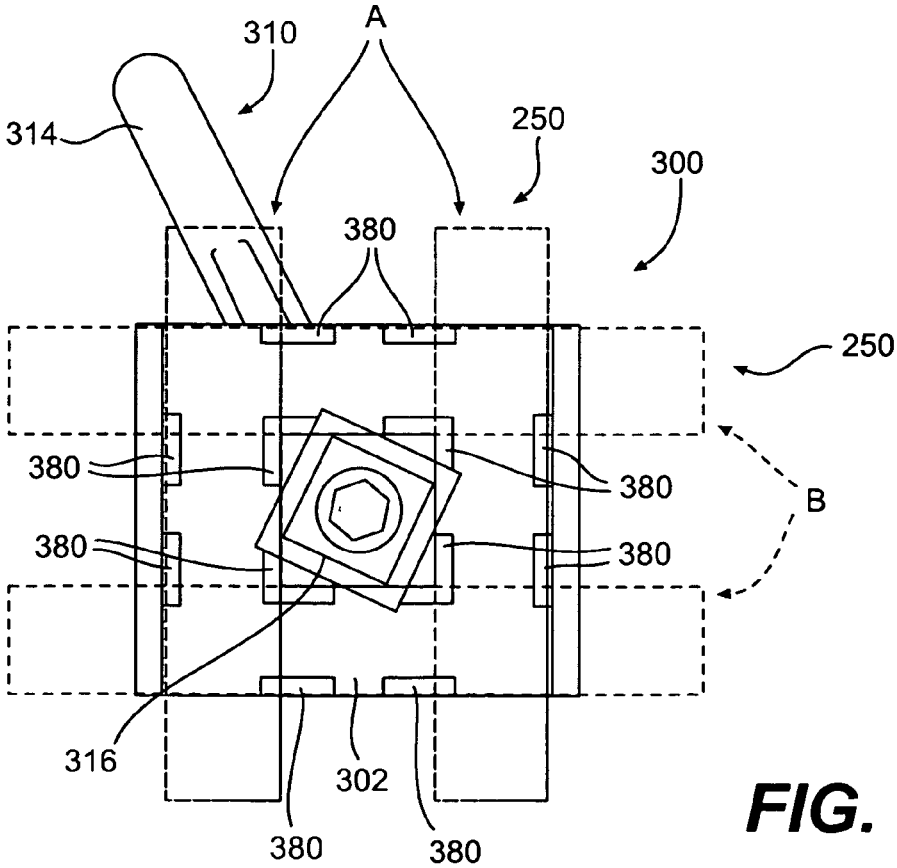
FIG. 35 is a bottom view of the vise shown in FIG. 34.
Figure 36:
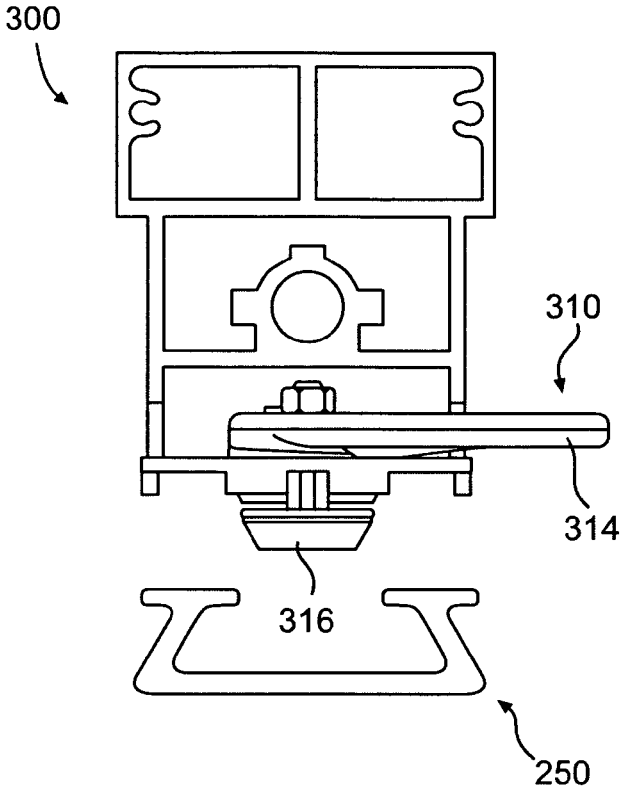
FIG. 36 is a front view of the vise shown in FIG. 30 being mounted from above to the additional main body shown in FIG. 28 such that the vise extends generally parallel with the main body.
Figure 37:
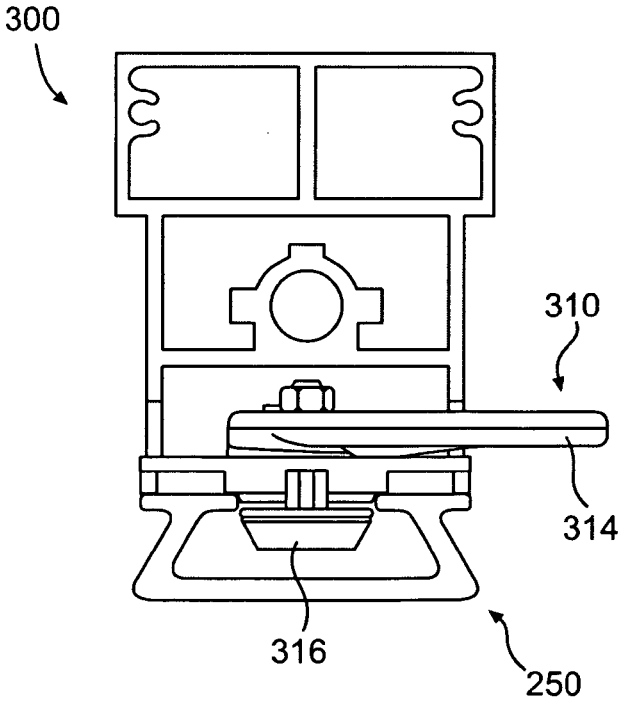
FIG. 37 is a front view of the vise shown in FIG. 30 mounted to the additional main body shown in FIG. 28 such that the vise extends generally parallel with the main body, and the clamp assembly in a released position.
Figure 38:
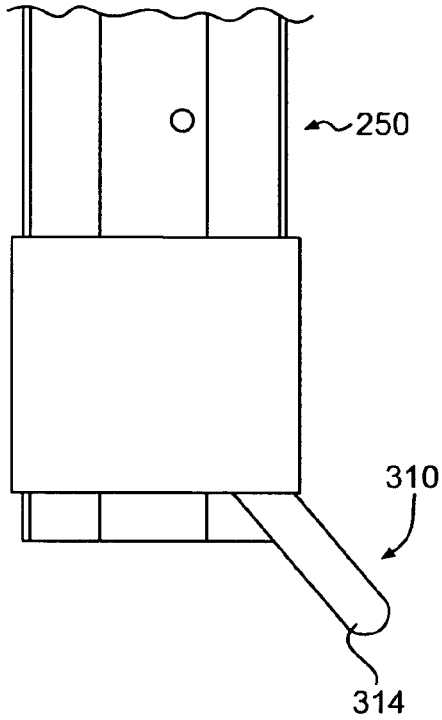
FIG. 38 is a top view of the vise shown in FIG. 37.
Figure 39:
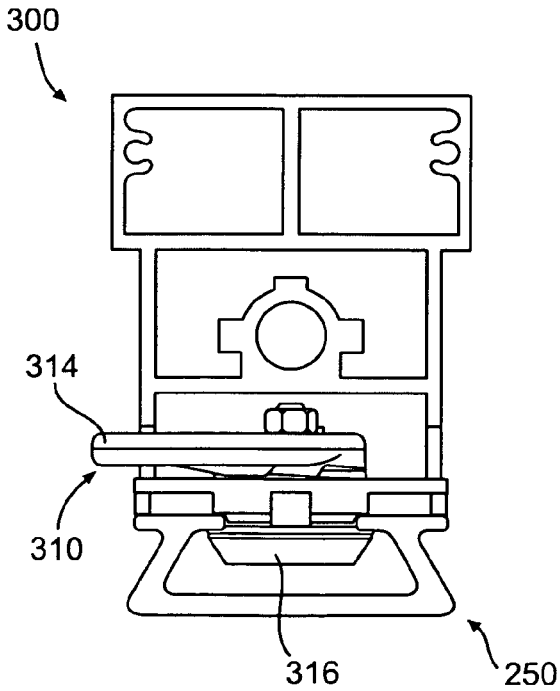
FIG. 39 is a front view of the vise shown in FIG. 30 mounted to the additional main body shown in FIG. 28 such that the vise extends generally parallel with the main body, and the clamp assembly in a locked position.
Figure 40:
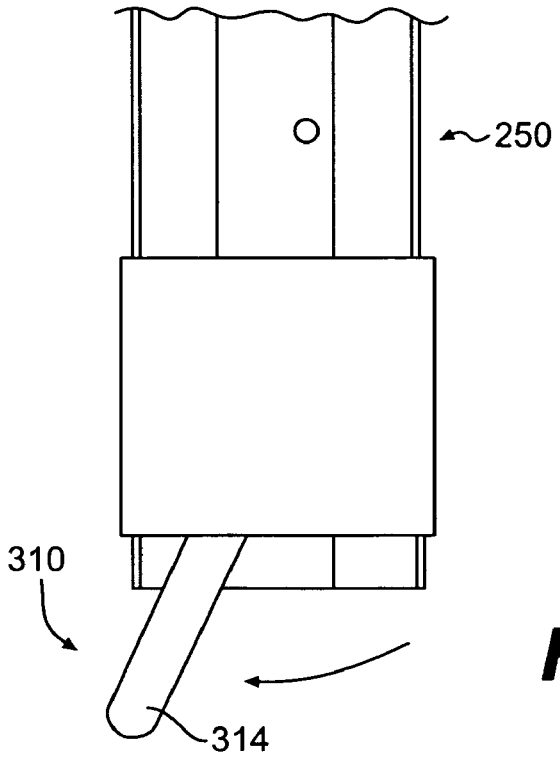
FIG. 40 is a top view of the vise shown in FIG. 39.
Figure 41:
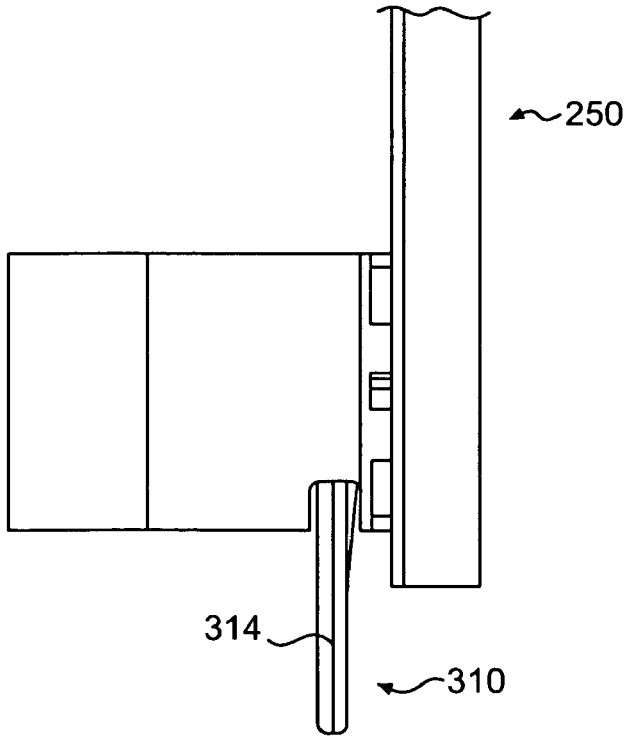
FIG. 41 is a side view of the vise shown in FIG. 39.
Figure 42:
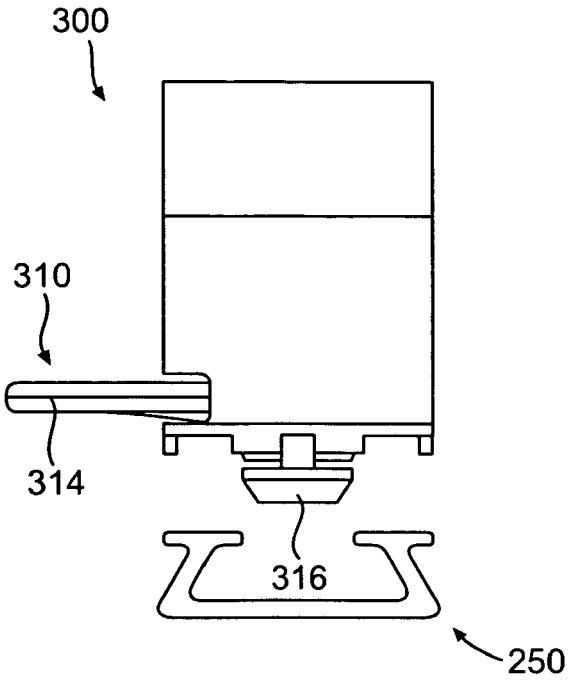
FIG. 42 is a front view of the vise shown in FIG. 30 being mounted from above to the additional main body shown in FIG. 28 such that the vise extends generally transverse with the main body.
Figure 43:
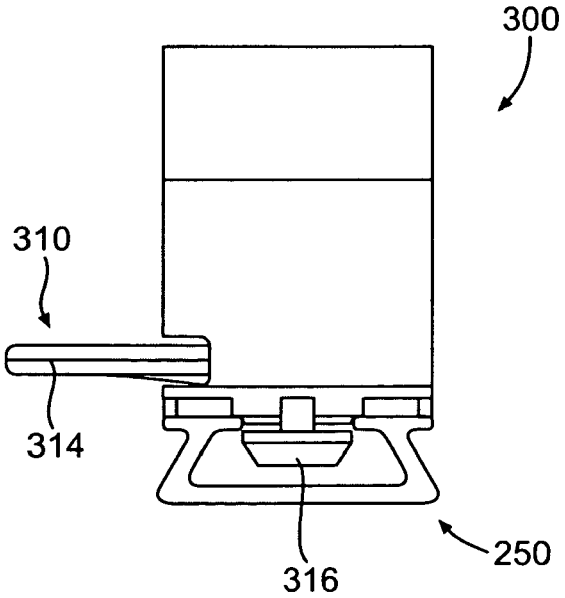
FIG. 43 is a front view of the vise shown in FIG. 30 mounted to the additional main body shown in FIG. 28 such that the vise extends generally transverse with the main body, and the clamp assembly in a released position.
Figure 44:
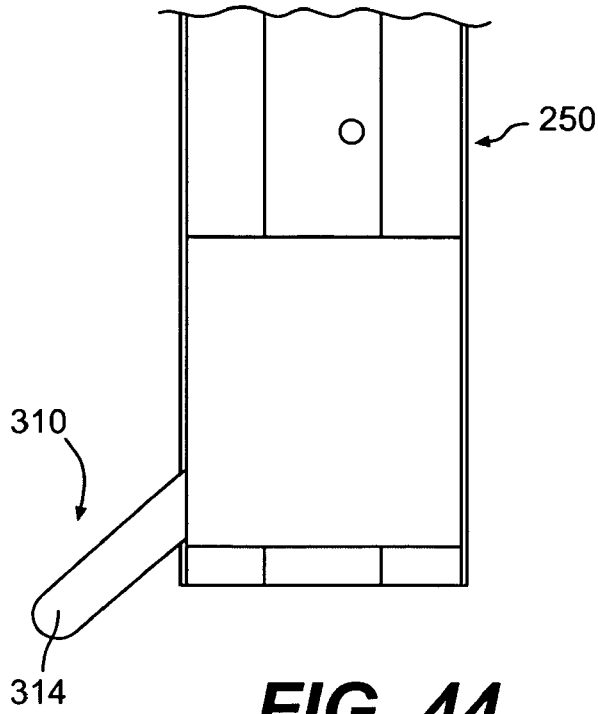
FIG. 44 is a top view of the vise shown in FIG. 43.
Figure 45:
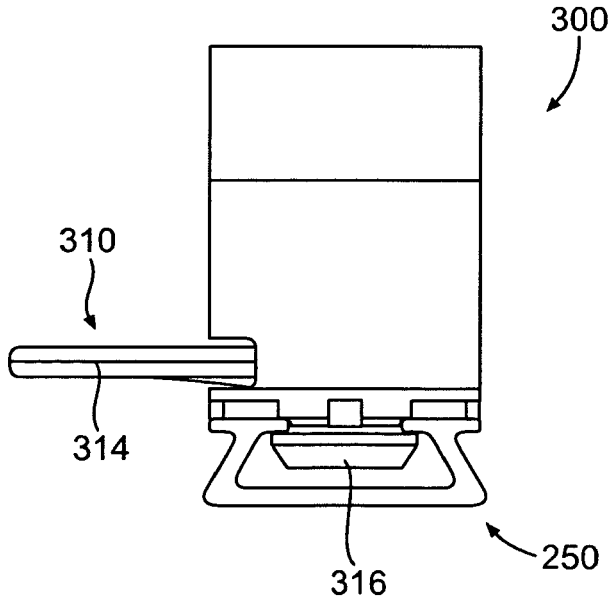
FIG. 45 is a front view of the vise shown in FIG. 30 mounted to the additional main body shown in FIG. 28 such that the vise extends generally transverse with the main body, and the clamp assembly in a locked position.
Figure 46:
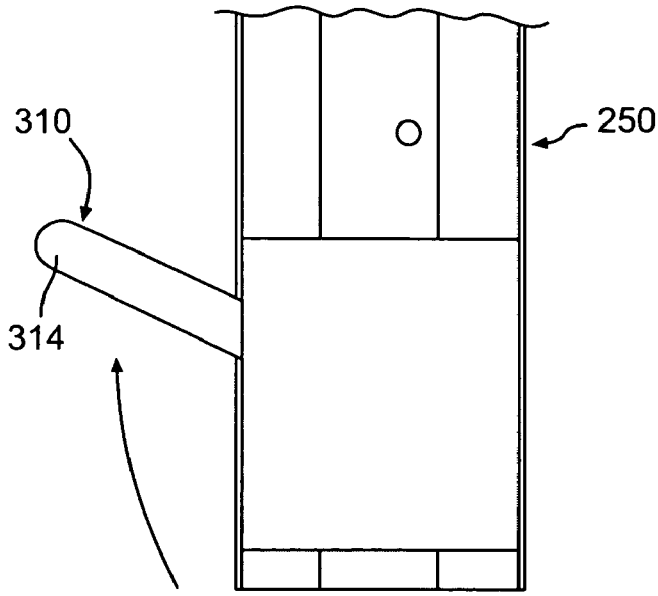
FIG. 46 is a top view of the vise shown in FIG. 45.
Figure 47:
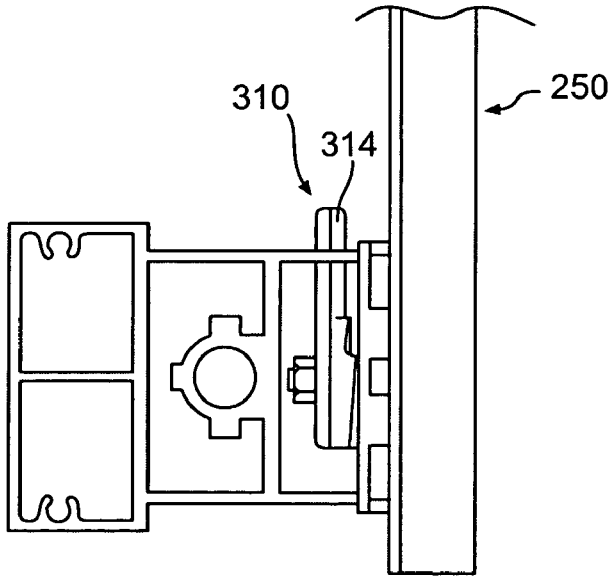
FIG. 47 is a side view of the vise shown in FIG. 45.

As best shown in FIGS. 30, 33, and 35, the base 302 includes a plurality of downwardly extending flanges 380. Specifically, the base 302 includes outer flanges 380 along the outer edges of the base 302 and inner flanges 380 along an inner portion of the base 302. When the vise 300 is mounted to the track portion of the work bench 10 or main body 250, the plurality of flanges 380 stably support the base portion 302 and vise 300 on the track portion. For example, FIG. 35 illustrates the vise 300 in the first position for holding items transverse to a track portion (Position A) and the second position for holding items parallel to a track portion (Position B). In both instances, the outer flanges 380 engage outer edges of the track portions and the inner flanges 380 engage inner edges of the track portions so as to stably support the base portion 302 on the track portion.

The clamp assembly 310 is structured to releasably mount the vise 300 to the track portion of the work bench 10 or main body 250. Specifically, the clamp assembly 310 includes a handle 314 pivotably mounted to the base 302 for movement between a released position (as shown in FIGS. 32, 33, 37, 38, 43, and 44) and a locked position (as shown in FIGS. 34, 35, 39, 40, 41, 45, 46, and 47). When the handle 314 is in the released position, the vise 300 may be engaged with the track portion, removed from the track portion, or slid along the track portion. When the handle 314 is in the locked position, the vise 300 is locked to the track portion to prevent any type of relative movement between the vise 300 and the track portion. The handle 314 of the clamp assembly 310 may be manually moved between the released and locked positions to remove, adjust, and mount the vise 300 to the track portion.

As shown in FIG. 31, the handle 314 is operatively engaged with a retaining member 316 to control the movement of the retaining member 316 into and out of engagement with the track portion. Specifically, a fastener 318 with a handle key 319 extends through an opening in the retaining member 316, through an opening in the base 302, and into a locking engagement with the handle 314 which mates with the handle key 319 and is threaded for the fastener 318. A nut 321 is used as a secondary fastener with the fastener 318. As a result, rotation of the handle 314 rotates the retaining member 316.

A spring (not shown) encircles the handle key 319 and is positioned between the retaining member 316 and the base 302 to bias the retaining member 316 away from the base 302. The base 302 has a handle mount 322 secured thereto. The handle mount 322 has a ramped surface 324 that extends in an arcuate path. The ramped surface 324 is engaged with a cooperating surface on the handle 314. The ramped surface 324 of the handle mount 322 and the cooperating surface on the handle 314 are configured such that, as the handle 314 is rotated from the released position to the locked position, the handle 314 is moved upwardly away from the base 302 by a camming action which moves the retaining member 316 upwardly towards the base 302 against biasing from the spring. Similarly, as the handle 314 is rotated from the locked position to the released position, the handle 314 is moved downwardly towards the base 302 which moves the retaining member 316 downwardly away from the base 302 with biasing from the spring. That is, as the handle 314 is rotated towards the locked position, the retaining member 316 moves upwardly as it rotates relative to the base 302. Similarly, as the handle 314 is rotated towards the released position, the retaining member 316 moves downwardly as it rotates relative to the base 302.

The retaining member 316 is structured such that, when the handle 314 is in the released position (as shown in FIGS. 36–38 and 42–44), the retaining member 316 is oriented such that it is not in a position to retain the vise 300 on the track portion. Thus, the vise 300 can be freely engaged with and disengaged from the track portion. That is, the retaining member 316 is oriented so that it can be lifted freely through the opening defined between the rail members of the track portion to enable removal of the vise 300. Moreover, the retaining member 316 is spaced from the rail members of the track portion when the vise 300 is engaged with the track portion and the handle 314 is in the released position, which allows the vise 300 to be rotated between the first and second positions of the vise 300.

When the handle 314 is moved from the released position to the locked position (as shown in FIGS. 35, 39–41, and 45–47), the handle 314 is moved upwardly which moves the retaining member 316 upwardly towards the base 302 and into forced engagement with the inwardly extending flanges of the track portion. Specifically, the comers of the retaining member 316 move upwardly as they rotate relative to the base 302, which orients opposing comers of the retaining member 316 into forced engagement with the inwardly extending flanges of the track portion (see FIG. 35). Thus, the retaining member 316 clamps the vise 300 to the track portion and prevents any relative movement of the vise 300 with respect to the track portion.

It should be understood that various components of each of the vise 200, 300, tool mount assembly 32, work support assembly 24, work support/stop assembly 26, and flip stop assemblies 28, 30 may be combined with one another to form one-piece structures in order to facilitate manufacturing and assembly.

An advantage of the work bench 10 is that it is portable and easily assembled and disassembled. When disassembled, the work bench 10 assumes a compact configuration that can be easily transported to another work site. The vise 200, 300, tool mount assembly 32, work support assembly 24, work support/stop assembly 26, and flip stop assemblies 28, 30 may be manually released and removed from the work bench 10 without having to resort to using tools.

It can thus be appreciated that the aspects of the present invention have now been fully and effectively accomplished. The foregoing specific embodiments have been provided to illustrate the structural and functional principle of the present invention, and are not intended to be limiting. To the contrary, the present invention is intended to encompass all modifications, alterations, and substitutions within the spirit and scope of the detailed description.

What is claimed is:

1. A work bench comprising:

an elongated main body including a track portion having first and second spaced apart rail members, the elongated main body having a channel extending longitudinally between the first and second rail members, the first and second rail members including flanges extending inwardly toward one another into the channel; and a tool mount assembly removably mounted to the track portion of the main body to stably support a tool on the main body, the tool mount assembly including a tool mount having a support structure that supports the tool and a releasable fastener mounted to the support structure to releasably interlock with the track portion so as to releasably mount the tool mount to the track portion, the releasable fastener including a handle movably mounted to the support structure and a retaining member, the retaining member being received in the channel between the rail members and being connected to the handle, the handle having a first cam surface engaged in a camming relationship with a second cam surface provided on the support structure to enable the handle to be moved to (a) a locked position wherein the first cam surface of the handle is cammed against the second cam surface to urge the retaining member towards the flanges of the spaced apart rail members so that ends of the retaining member are moved into forced engagement with the flanges to secure the tool mount to the track portion and prevent relative movement of the tool mount with respect to the track portion, and (b) a released position wherein the first and second cam surfaces are positioned to relieve the forced engagement and the retaining member is positioned so that the tool mount can be engaged with or disengaged from the track portion.

2. The work bench according to claim 1, wherein the retaining member has a long axis and a short axis, wherein the long axis is longer than a distance between the flanges and the short axis is shorter than the distance between the flanges such that (a) in the released position of the handle, the retaining member is oriented with its short axis substantially transverse to the longitudinal direction of the track portion to enable the retaining member to be moved inwardly or outwardly between the flanges of the spaced apart rail members to enable the tool mount to be engaged with or disengaged from the track portion, and (b) in the locked position of the handle, the retaining member is oriented with its long axis substantially transverse to the longitudinal direction of the track portion for enabling the ends of the retaining member to be in the forced engagement with the flanges of the spaced apart rail members as aforesaid.

3. The work bench according to claim 2, wherein the handle is movable to an intermediate position wherein the retaining member is oriented with its long axis substantially transverse to the longitudinal direction of the track portion and the first and second cam surfaces are positioned to relieve the forced engagement of the ends of the retaining member with the flanges to prevent outward removal of the retaining member between the spaced apart rail members but allow longitudinal sliding movement of the tool mount along the track portion.

4. A work bench according to claim 3, wherein the retaining member has an elongated configuration with its long and short axes substantially perpendicular to one another.

5. A work bench according to claim 3, wherein the retaining member has a generally square configuration with its long axis extending between a pair of opposing corners and its short axis extending between a pair of opposing sides.

6. A work bench according to claim 2, wherein the retaining member has an elongated configuration with its long and short axes substantially perpendicular to one another.

7. A work bench according to claim 2, wherein the retaining member has a generally square configuration with its long axis extending between a pair of opposing corners and its short axis extending between a pair of opposing sides.

8. The work bench according to claim 1, further comprising a plurality of support legs that are structured to support the main body in an elevated position above a ground surface.

9. The work bench according to claim 7, wherein the support legs are pivotally movable between open and closed positions, the support legs supporting the main body in the elevated position when in the open position.

10. The work bench according to claim 1, wherein the main body further includes a second track portion and a third track portion, the second and third track portions each supporting a support arm that is movable relative the main body between a retracted position and an extended position in which a free end of a respective support arm extends outwardly away from the main body.

11. The work bench according to claim 10, further comprising an adjustable stop arm that is telescopically mounted to one of the support arms for movement between a retracted position and an extended position in which a free end of the stop arm extends outwardly away from a respective support arm.

12. The work bench according to claim 11, further comprising a flip stop assembly mounted on the stop arm, the flip stop assembly including a support extension removably engagable with the stop arm and a stop beam that is positioned to engage an item to be manipulated by the tool mounted on the tool mount assembly so that the stop beam sets a desired length of the item to be manipulated.

13. The work bench according to claim 10, further comprising an adjustable work support assembly mounted on at least one of the support arms, the work support assembly including a support extension removably engagable with a respective support arm and a support beam that supports an item in an elevated position at a height that corresponds to a height of a working surface of the tool mounted on the tool mount assembly.

14. The work bench according to claim 10, wherein each support arm includes a releasable fastener to releasably lock each support arm with respect to the main body.

15. The work bench according to claim 1, wherein the tool mount assembly includes first and second tool mounts, one of the tool mount supporting one side of the tool and the other of the tool mounts supporting the other side of the tool.

16. The work bench according to claim 15, wherein the support structure of each tool mount includes a base and a support beam mounted to the base, the support beam of the tool mounts supporting the tool therebetween.

17. The work bench according to claim 1, further comprising a vise that is mountable to the track portion of the main body in (a) a first position where it can hold items transverse to the work bench, and (b) a second position where it can hold items parallel to the work bench.

18. The work bench according to claim 17, wherein the vise comprises:

a base;

a pair of engagement members provided on the base, the engagement members being relatively movable toward and away from one another for grasping and releasing a workpiece; and a releasable fastener mounted to the base to releasably interlock with the track portion so as to releasably mount the vise to the track portion, the releasable fastener of the vise including a handle movably mounted to the base and a retaining member, the retaining member being received in the channel between the rail members and being connected to the handle, the handle of the vise having a first cam surface engaged in a camming relationship with a second cam surface provided on the base of the vise to enable the handle of the vise to be moved to (a) a locked position wherein the first cam surface of the handle of the vise is cammed against the second cam surface of the base of the vise to urge the retaining member of the vise towards the flanges of the spaced apart rail members so that ends of the retaining member of the vise are moved into forced engagement with the flanges to secure the vise to the track portion and prevent relative movement of the vise with respect to the track portion, and (b) a released position wherein the first and second cam surfaces of the vise's base and handle are positioned to relieve the forced engagement and the retaining member of the vise is positioned so that the vise can be engaged with or disengaged from the track portion.

19. The work bench according to claim 18, wherein the retaining member of the vise has a long axis and a short axis, wherein the long axis of the retaining member of the vise is longer than a distance between the flanges and the short axis is shorter than the distance between the flanges such that (a) in the released position of the handle of the vise, the retaining member of the vise is oriented with its short axis substantially transverse the longitudinal direction of the track portion to enable the retaining member to be moved inwardly or outwardly between the flanges of the spaced apart rail members to enable the vise to be engaged with or disengaged from the track portion, and (b) in the locked position of the handle of the vise, the retaining member of the vise is oriented with its long axis substantially transverse to the longitudinal direction of the track portion for enabling the ends of the retaining member of the vise to be in the forced engagement with the flanges of the spaced apart rail members as aforesaid.

20. A work bench comprising:

an elongated main body including a track portion having first and second spaced apart rail members, the elongated main body having a channel extending longitudinally between the first and second rail members, the first and second rail members including flanges extending inwardly toward one another into the channel; and a tool mount assembly removably mounted to the track portion of the main body to stably support a tool on the main body, the tool mount assembly including a tool mount having a support structure that supports the tool and a releasable fastener mounted to the support structure to releasably interlock with the track portion so as to releasably mount the tool mount to the track portion, the releasable fastener including a handle movably mounted to the support structure and a retaining member, the retaining member being received in the channel between the rail members and having a long axis and a short axis, the long axis being longer than a distance between the flanges and the short axis being shorter than the distance between the flanges, the retaining member being connected to the handle such that manual movement of the handle to (a) a released position orients the retaining member with its short axis substantially transverse to the longitudinal direction of the track portion to enable the retaining member to be moved inwardly or outwardly between the flanges of the spaced apart rail members to enable the tool mount to be engaged with or disengaged from the track portion, and (b) a locked position orients the retaining member with its long axis substantially transverse to the longitudinal direction of the track portion, wherein in the locked position the retaining member is in forced engagement with the flanges of the spaced apart rail members to secure the tool mount to the track portion and prevent relative movement of the tool mount with respect to the track portion.

21. A work bench according to claim 20, wherein the retaining member has an elongated configuration with its long and short axes substantially perpendicular to one another.

22. A work bench according to claim 20, wherein the retaining member has a generally square configuration with its long axis extending between a pair of opposing corners and its short axis extending between a pair of opposing sides.

23. A work bench comprising:

an elongated main body including a track portion having first and second spaced apart rail members, the elongated main body having a channel extending longitudinally between the first and second rail members, the first and second rail members including flanges extending inwardly toward one another into the channel; and an accessory removably mounted to the track portion of the main body, the accessory including a base and a releasable fastener mounted to the base to releasably interlock with the track portion so as to releasably mount the accessory to the track portion, the releasable fastener including a handle movably mounted to the base and a retaining member, the retaining member being received in the channel between the rail members and being connected to the handle, the handle having a first cam surface engaged in a camming relationship with a second cam surface provided on the base to enable the handle to be moved to (a) a locked position wherein the first cam surface of the handle is cammed against the second cam surface to urge the retaining member towards the flanges of the spaced apart rail members so that ends of the retaining member are moved into forced engagement with the flanges to secure the accessory to the track portion and prevent relative movement of the accessory with respect to the track portion, and (b) a released position wherein the first and second cam surfaces are positioned to relieve the forced engagement and the retaining member is positioned so that the tool mount can be engaged with or disengaged from the track portion.

24. The work bench according to claim 23, wherein the retaining member has a long axis and a short axis, wherein the lone axis is longer than a distance between the flanges and the short axis is shorter than the distance between the flanges such that (a) in the released position of the handle, the retaining member is oriented with its short axis substantially transverse in the longitudinal direction of the track portion to enable the retaining member to be moved inwardly or outwardly between the flanges of the spaced apart rail members to enable the accessory to be engaged with or disengaged from the track portion, and (b) in the locked position of the handle, the retaining member is oriented with its long axis substantially transverse to the longitudinal direction of the track portion for enabling the ends of the retaining member to be in the forced engagement with the flanges of the spaced apart rail members as aforesaid.

25. The work bench according to claim 24, wherein the handle is movable to an intermediate position wherein the retaining member is oriented with its long axis substantially transverse to the longitudinal direction of the track portion and the first and second cam surfaces are positioned to relieve the forced engagement of the ends of the retaining member with the flanges to prevent outward removal of the retaining member between the spaced apart rail members but allow longitudinal sliding movement of the accessory along the track portion.

26. A work bench according to claim 25, wherein the retaining member has an elongated configuration with its long and short axes substantially perpendicular to one another.

27. A work bench according to claim 25, wherein the retaining member has a generally square configuration with its long axis extending between a pair of opposing corners and its short axis extending between a pair of opposing sides.

28. A work bench according to claim 24, wherein the retaining member has an elongated configuration with its long and short axes substantially perpendicular to one another.

29. A work bench according to claim 24, wherein the retaining member has a generally square configuration with its long axis extending between a pair of opposing corners and its short axis extending between a pair of opposing sides.

30. A work bench comprising:

an elongated main body including a track portion having first and second spaced apart rail members, the elongated main body having a channel extending longitudinally between the first and second rail members, the first and second rail members including flanges extending inwardly toward one another into the channel; and an accessory removably mounted to the track portion of the main body, the accessory including a base and a releasable fastener mounted to the base to releasably interlock with the track portion so as to releasably mount the accessory to the track portion, the releasable fastener including a handle movably mounted to the base and a retaining member, the retaining member being received in the channel between the rail members and having a long axis and a short axis, the long axis being longer than a distance between the flanges and the short axis being shorter than the distance between the flanges, the retaining member being connected to the handle such that manual movement of the handle to (a) a released position orients the retaining member with its short axis substantially transverse to the longitudinal direction of the track portion to enable the retaining member to be moved inwardly or outwardly between the flanges of the spaced apart rail members to enable the accessory to be engaged with or disengaged from the track portion, and (b) a locked position orients the retaining member with its long axis substantially transverse to the longitudinal direction of the track portion, wherein in the locked position the retaining member is in forced engagement with the flanges of the spaced apart rail members to secure the accessory to the track portion and prevent relative movement of the accessory with respect to the track portion.

31. A work bench according to claim 30, wherein the retaining member has an elongated configuration with its long and short axes substantially perpendicular to one another.

32. A work bench according to claim 30, wherein the retaining member has a generally square configuration with its long axis extending between a pair of opposing corners and its short axis extending between a pair of opposing sides.

* * * * *